US012110205B2

(12) United States Patent
Sugai

(10) Patent No.: US 12,110,205 B2
(45) Date of Patent: Oct. 8, 2024

(54) SHEET PROCESSING APPARATUS AND IMAGE FORMING SYSTEM

(71) Applicant: CANON KABUSHIKI KAISHA, Tokyo (JP)

(72) Inventor: Nobutoshi Sugai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/189,121

(22) Filed: Mar. 23, 2023

(65) Prior Publication Data

US 2023/0312297 A1 Oct. 5, 2023

(30) Foreign Application Priority Data

Apr. 5, 2022 (JP) ..... 2022-063058

(51) Int. Cl.
*B65H 31/32* (2006.01)
*B65H 31/30* (2006.01)
*B65H 37/04* (2006.01)

(52) U.S. Cl.
CPC ..... *B65H 31/3027* (2013.01); *B65H 31/32* (2013.01); *B65H 37/04* (2013.01); *B65H 2404/144* (2013.01); *B65H 2408/12* (2013.01); *B65H 2513/11* (2013.01); *B65H 2601/521* (2013.01); *B65H 2701/1311* (2013.01); *B65H 2701/18292* (2013.01); *B65H 2701/20* (2013.01); *B65H 2801/27* (2013.01)

(58) Field of Classification Search
CPC ..... B65H 2701/20; B65H 31/32; B65H 2601/521; B65H 31/3027; B65H 2404/144; B65H 2513/11; B65H 2701/1829; B65H 2801/27; B65H 2404/693; B65H 2701/1311; B65H 2404/61; B65H 2404/691
See application file for complete search history.

(56) References Cited

U.S. PATENT DOCUMENTS

2016/0347572 A1* 12/2016 Noso ..... B65H 31/10
2019/0308841 A1* 10/2019 Kaneko ..... B65H 31/36
2020/0339370 A1* 10/2020 Kotani ..... B65H 29/14
2020/0377323 A1* 12/2020 Nakahata ..... B65H 31/3009

FOREIGN PATENT DOCUMENTS

JP 2002-154726 A 5/2002
JP 2002-265123 A 9/2002
JP 2010-137950 A 6/2010

* cited by examiner

*Primary Examiner* — Jennifer Bahls
(74) *Attorney, Agent, or Firm* — Canon U.S.A., Inc. IP Division

(57) ABSTRACT

A sheet processing apparatus includes a discharge unit, a loading unit, an abutting unit, a support unit, and a control unit. The discharge unit discharges, from a discharge port, a sheet bundle transported along a transport path. The loading unit is loaded by the sheet bundle being discharged onto the loading unit. The abutting unit is disposed forward from the discharge port in a discharge direction of the sheet bundle so that the abutting unit abuts with a top surface of the discharged sheet bundle. The support unit is protrusible from and retractable into the discharge port and protrudes to an underside of the sheet bundle temporarily to support the sheet bundle when the sheet bundle is discharged. The control unit controls movement of the support unit such that the support unit reaches a position of the abutting unit after the sheet bundle abuts with the abutting unit.

13 Claims, 15 Drawing Sheets

SHEET PROCESSING APPARATUS AND IMAGE FORMING SYSTEM

BACKGROUND

Field

The present disclosure relates to a sheet processing apparatus and an image forming system.

Description of the Related Art

Thus far, a post-processing apparatus is known which is connected to a back end of an image forming apparatus and which performs post-processing such as alignment processing for aligning the edge parts of sheets passed from the image forming apparatus and stapling processing for stapling those sheets.

Japanese Patent Laid-Open No. 2002-265123 discloses a technique for supporting the attitude of large sheets drawn into a processing tray within a post-processing apparatus by using a protrusible tray which temporarily protrudes to the exterior of the apparatus, in order to prevent the sheets from becoming misaligned in the processing tray. The post-processing apparatus of Japanese Patent Laid-Open No. 2002-265123 also has a mechanism that further improves the alignment of a sheet bundle on the processing tray by pressing the sheet bundle using a belt-shaped member that abuts with the sheets being pulled into the processing tray.

It is desirable that sheet alignment be maintained when sheets are discharged from the apparatus after processing. For example, a sheet to be discharged may be pressed down by a pressing member to ensure the attitude of the sheet is not disturbed by the effects of air resistance as the sheet falls into the tray to which the sheet is to be discharged. However, it is necessary for such a pressing member to be arranged so as to overlap in the discharge direction of the sheet, and if the attitude of the sheet is also to be supported by the protrusible tray, the pressing member and the protrusible tray will interfere or collide with each other. Collisions between the pressing member and the protrusible tray produce a collision sound which is unpleasant for users.

SUMMARY

The present disclosure provides an improved mechanism that, by using both a pressing member and a protrusible tray, achieves both an improvement in sheet alignment and a reduction in collision sounds caused by collisions between the pressing member and the protrusible tray.

According to an aspect of the present disclosure, a sheet processing apparatus includes a discharge unit configured to discharge, from a discharge port, a sheet bundle transported along a transport path, a loading unit onto which the sheet bundle that has been discharged is loaded, an abutting unit disposed forward from the discharge port in a discharge direction of the sheet bundle so that the abutting unit abuts with a top surface of the sheet bundle that has been discharged, a support unit that is protrusible from and retractable into the discharge port and is configured to protrude to an underside of the sheet bundle temporarily to support the sheet bundle when the sheet bundle is discharged, and a control unit configured to control movement of the support unit such that the support unit reaches a position of the abutting unit after the sheet bundle abuts with the abutting unit.

Further features of the present disclosure will become apparent from the following description of exemplary embodiments (with reference to the attached drawings).

DESCRIPTION OF THE EMBODIMENTS

Figure 1:
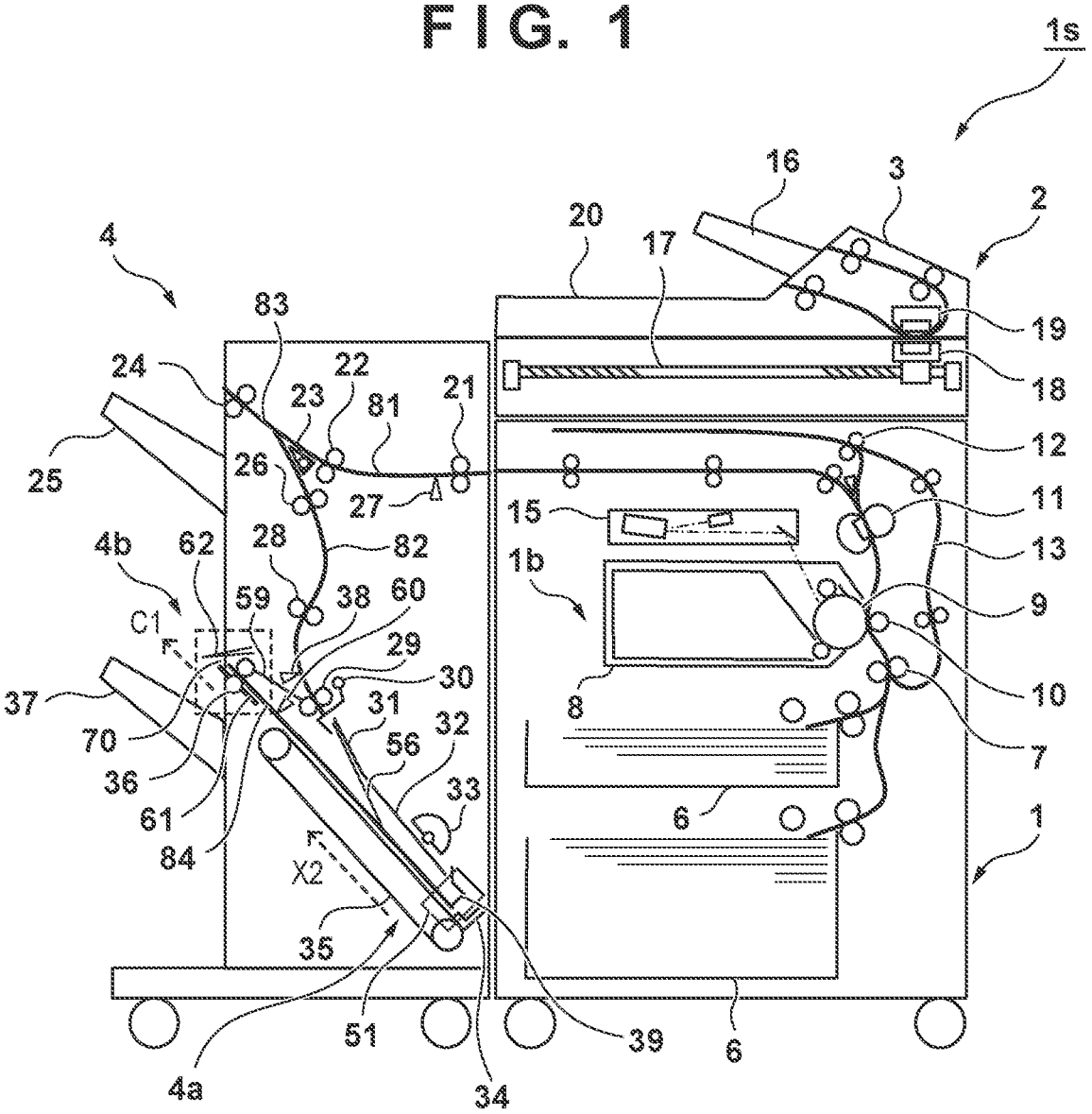
FIG. 1 is a schematic diagram illustrating an example of the configuration of an image forming system according to an embodiment.

Hereinafter, embodiments will be described in detail with reference to the attached drawings. Note, the following embodiments are not intended to limit the scope of the disclosure. Multiple features are described in the embodiments, but limitation is not made to an embodiment that requires all such features, and multiple such features may be combined as appropriate. Furthermore, in the attached drawings, the same reference numerals are given to the same or similar configurations, and redundant description thereof is omitted.

1. Example of Overall Configuration of System

FIG. 1 is a schematic diagram illustrating an example of the configuration of an image forming system is according to an embodiment. Referring to FIG. 1, the image forming system is includes an image forming apparatus 1, a reading apparatus 2, and a post-processing apparatus 4. The image forming apparatus 1 forms an image on a sheet (also called a "recording material"). The reading apparatus 2 optically reads a document and generates read image data. The post-processing apparatus 4 is connected to the image forming apparatus 1, receives a sheet from the image forming apparatus 1, and performs post-processing (described later) on the received sheet.

In general, the technique according to the present disclosure can be applied to a sheet processing apparatus that discharges sheets to the outside of the apparatus after performing some kind of processing on the sheets. The present embodiment will mainly describe an example in which the post-processing apparatus 4 is a sheet processing apparatus. However, in another embodiment, the image forming apparatus may be a sheet processing apparatus.

2. Example of Configuration of Reading Apparatus

In the example illustrated in FIG. 1, the reading apparatus 2 is integrated with a document feed apparatus 3. The reading apparatus 2 further includes a document tray 16, a drive unit 17, a first reading unit 18, a second reading unit 19, and a discharge tray 20. The document feed apparatus 3 transports a document placed on the document tray 16 along a transport path to a reading position. The first reading unit 18 includes an image sensor array, and generates read image data by optically reading a first surface of the document that reaches the reading position. The second reading unit 19 also includes an image sensor array, and generates read image data by optically reading a second surface of the document that reaches the reading position. The document that has passed the reading position is discharged to the discharge tray 20. The first reading unit 18 can move horizontally by being driven by the drive unit 17, and can also optically read a document (e.g., a booklet document) placed on a document platform glass while moving.

3. Example of Configuration of Image Forming Apparatus

In the example illustrated in FIG. 1, the image forming apparatus 1 is a black-and-white printer that operates according to the electrophotographic method. The image forming apparatus 1 includes an image forming unit 1*b* that forms an image on a sheet using a direct transfer method. The image forming unit 1*b*. includes a process cartridge 8 and a scanner unit 15. The process cartridge 8 includes a photosensitive drum 9. The scanner unit 15 writes an electrostatic latent image onto the surface of the photosensitive drum 9, which is rotating and has been charged, by exposing the surface of the photosensitive drum 9 with a laser beam according to input image data. The written electrostatic latent image is developed by supplying charged toner particles, and a toner image is formed as a result. The toner image is carried on the photosensitive drum 9 and reaches a transfer position between the photosensitive drum 9 and a transfer roller 10. When a copy job is executed, the input image data is the read image data generated by one or both of the first reading unit 18 and the second reading unit 19 of the reading apparatus 2. When a print job is executed, the input image data is received from an external apparatus over a network.

The image forming apparatus 1 further includes a cassette 6 that accommodates a bundle of sheets. The sheets are separated from the cassette 6 and transported one by one along the transport path by a paper feed mechanism. A registration roller 7 corrects skew in the transported sheet and transports the sheet to the transfer position. The toner image carried by the photosensitive drum 9 is transferred to the surface of the sheet at the transfer position. The sheet is then transported from the transfer position to a fixing unit 11 located downstream. The fixing unit 11 fixes the toner image onto the sheet by heating the toner with a heating element such as a halogen lamp while pressing the sheet between a pair of rollers. When double-sided printing is performed, the sheet that has passed through the fixing unit 11 is switched back by a reversing roller 12 and is transported to the transfer position again, this time with the front and back sides reversed, through a re-transport path 13. The toner image carried by the photosensitive drum 9 is then transferred to the back surface of the sheet at the transfer position. Furthermore, the sheet passes through the fixing unit 11 again. The sheet which has finished single-sided printing or double-sided printing is passed to the post-processing apparatus 4.

Note that the configurations of the image forming apparatus 1 and reading apparatus 2 described here are only examples. The image forming apparatus 1 may operate using another image forming method, such as the ink jet method or the offset printing method. The image forming apparatus 1 may also be a color printer. The image forming unit 1*b* may also operate using an intermediate transfer method, in which the image is transferred from the photosensitive drum to the sheet via an intermediate transfer member, instead of the direct transfer method. The reading apparatus 2 does not have to include the document feed apparatus 3.

4. Example of Configuration of Post-Processing Apparatus

The post-processing apparatus 4 includes: a transport path constituted by a receiving path 81, an internal path 82, a first discharge path 83, and a second discharge path 84; an upper discharge tray 25; a post-processing unit 4*a*; a bundle discharge unit 4*b*; and a lower discharge tray 37. The receiving path 81 is a path for accepting sheets from the image forming apparatus 1. The internal path 82 is a path for transporting sheets to the post-processing unit 4*a*. The first discharge path 83 is a path for discharging sheets to the upper discharge tray 25. The second discharge path 84 is a path for discharging sheets from a discharge port 70 of the bundle discharge unit 4*b* to the lower discharge tray 37.

An entrance roller 21, which is disposed near an entrance of the receiving path 81, draws in a sheet discharged from the image forming apparatus 1 into the receiving path 81 and transports that sheet to a buffer front roller 22. An entrance sensor 27, which is disposed between the entrance roller 21 and the buffer front roller 22, detects the sheet passing through the receiving path 81. The buffer front roller 22 transports the sheet to the first discharge path 83. A reversing roller 24, which is disposed in the first discharge path 83, discharges the transported sheet to the upper discharge tray 25 when the upper discharge tray 25 is specified as a sheet discharge destination. In this case, no post-processing is applied to the sheets passed from the image forming apparatus 1. If the lower discharge tray 37 is specified as the sheet discharge destination, the reversing roller 24 switches back the sheet and transports the sheet to the internal path 82. A backflow prevention valve 23 prevents the sheet being switched back from flowing back into the receiving path 81. The sheet entering the internal path 82 is transported toward the post-processing unit 4*a* by an inner discharge roller 26, an intermediate transport roller 28, and a kick-out roller 29, in that order. An intermediate sensor 38 detects a sheet passing between the intermediate transport roller 28 and the kick-out roller 29.

In the present embodiment, the post-processing unit 4*a* aligns a plurality of sheets received from the internal path 82. The post-processing unit 4*a* further includes a stapler 51 that can staple a bundle of the aligned sheets. The bundle of sheets processed by the post-processing unit 4*a* is transported along the second discharge path 84 by a following edge of the bundle being pushed by a discharge guide 34, which slides in a discharge direction X2, and the bundle is passed to discharge rollers 36. An exit sensor 60, which is a detection unit, detects a sheet passing through a detection position (a position d1, described later) in the second discharge path 84 in front of the discharge port 70 (in front of the discharge rollers 36, in the example in FIG. 1). The pair of discharge rollers 36, which are a discharge unit, discharge the passed bundle of sheets from the discharge port 70 to the lower discharge tray 37, which is a loading unit. The discharged bundle of sheets is loaded onto the lower discharge tray 37.

The entrance sensor 27, the intermediate sensor 38, and the exit sensor 60 described above may, for example, be optical sensors (e.g., photointerrupters) that detect the presence of a sheet at the corresponding detection position when incident light is blocked by the sheet.

A protrusible tray 61 is a support unit which is disposed between the second discharge path 84 and the lower discharge tray 37, and which is configured to be protrusible from and retractable into the discharge port 70. The protrusible tray 61 is retracted to a retracted position inside the discharge port 70 when no sheet bundles are discharged. When a sheet bundle is discharged from the discharge port 70, the protrusible tray 61 temporarily protrudes to the underside of the sheet bundle to support the sheet bundle. More specifically, when a leading edge of a sheet bundle reaches the detection position of the exit sensor 60 and the exit sensor 60 detects the presence of the sheet bundle, the protrusible tray 61 waits for a given time duration under the control of a control unit (described later), and then protrudes from the discharge port 70 in a direction C1 at the underside of the sheet bundle. The protrusible tray 61 which has protruded supports the sheet bundle at a lower surface thereof and helps maintain the attitude of the sheet bundle during discharge. Thereafter, when the following edge of the bundle reaches the aforementioned detection position, the exit sensor 60 no longer detects the presence of the sheet bundle. The protrusible tray 61 then moves in the opposite direction from the direction C1 and retracts to the original retracted position. The sheet bundle no longer supported by the protrusible tray 61 is discharged to the lower discharge tray 37.

A pressing member 62 is a plate-shaped abutting unit configured to be capable of pivoting about a pivot shaft disposed above the discharge port 70. A part of the pressing member 62 on a free end side thereof is, in a standby state, positioned forward in a discharge direction of the sheet bundle from the discharge port 70 (a position d3, described later). The pressing member 62 is pushed and pivoted by the leading edge of the sheet bundle being discharged from the discharge port 70, abuts with the top surface of the sheet bundle, and presses down on the sheet bundle, which facilitates the sheet bundle dropping onto the lower discharge tray 37. That is, in the present embodiment, the pressing member 62 works in cooperation with the protrusible tray 61 to help maintain the attitude of the sheet bundle to be discharged to the lower discharge tray 37. If there is no sheet bundle in the protruding position where the protrusible tray 61 protrudes to a maximum extent in the direction C1, the protrusible tray 61 will interfere or collide with the pressing member 62. However, in the present embodiment, as a result of timing control (described later), the protrusible tray 61 and the pressing member 62 sandwich the sheet bundle from both above and below, and the protrusible tray 61 and the pressing member 62 therefore do not collide directly with each other.

The upper discharge tray 25 and the lower discharge tray 37 are configured to be capable of ascending and descending in the vertical direction in the drawings. For example, each of the upper discharge tray 25 and lower discharge tray 37 descends downward when a sheet is discharged to that tray. Likewise, each tray ascends upward when a sheet is removed from that tray. As a result, the position of the uppermost surface of the sheet bundle loaded on each tray is adjusted to be constant. The post-processing apparatus 4 may include a sheet surface sensor (not shown) to detect the discharge of a sheet to each tray and the removal of a sheet from each tray. The post-processing apparatus 4 may include motors for driving the upper discharge tray 25 and the lower discharge tray 37, respectively. Alternatively, each of the upper discharge tray 25 and lower discharge tray 37 may be biased upward by a spring, for example, and descend downward by the weight of the sheet.

5. Example of Detailed Configuration of Post-Processing Unit

Figure 2A:
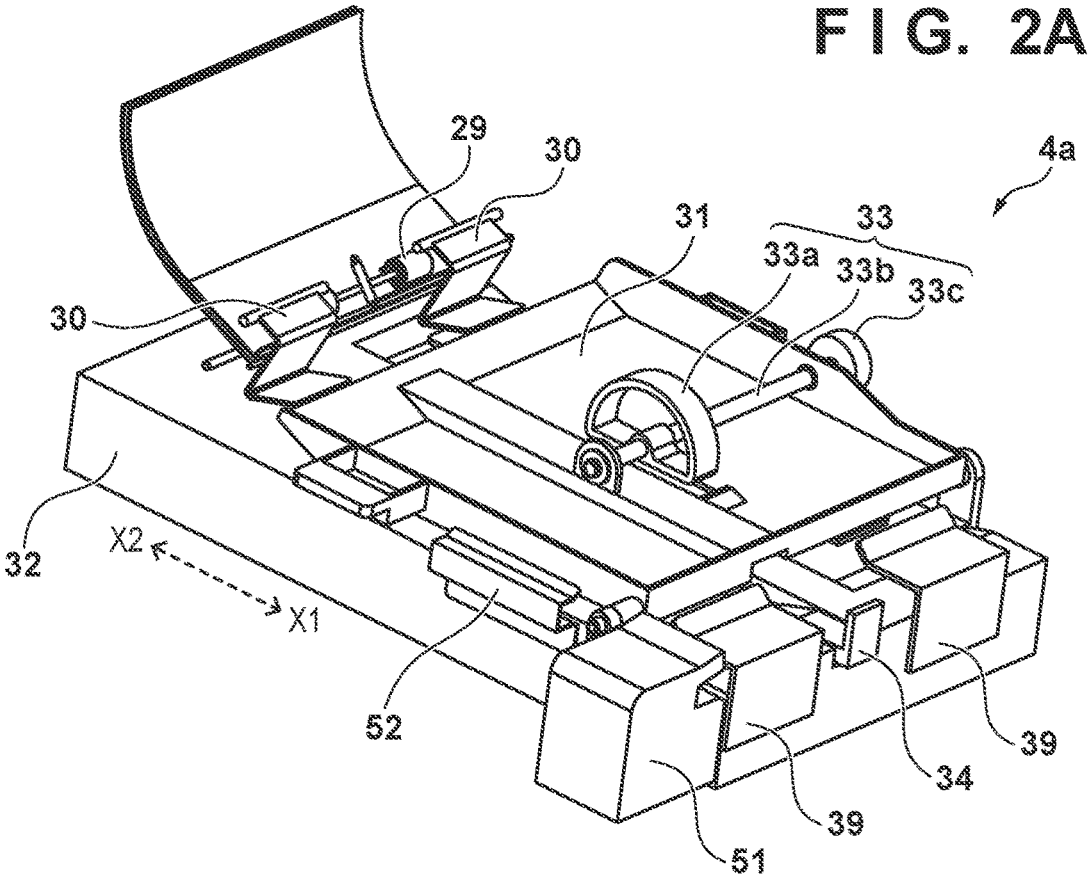
FIG. 2A is a first perspective view illustrating an example of the configuration of a post-processing unit according to an embodiment.
Figure 2B:
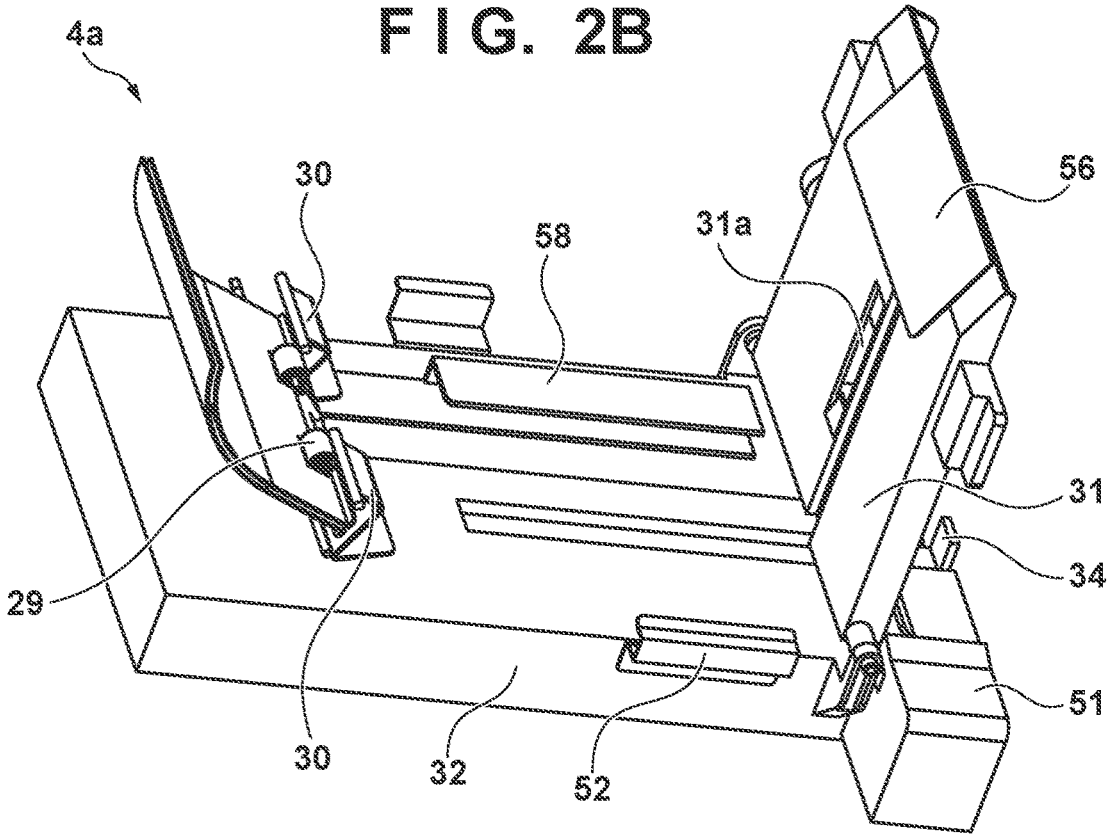
FIG. 2B is a second perspective view illustrating an example of the configuration of a post-processing unit according to an embodiment.

FIGS. 2A and 2B are perspective views illustrating an example of the configuration of the post-processing unit 4*a*. FIG. 2A illustrates an upper guide 31 of the post-processing unit 4*a* in a closed state, and FIG. 2B illustrates the upper guide 31 of the post-processing unit 4*a* in an open state. In the present embodiment, the post-processing unit 4*a* is a processing unit that performs at least one of alignment processing that aligns a sheet bundle or stapling processing that staples a sheet bundle.

As illustrated in FIGS. 1, 2A, and 2B, the post-processing unit 4*a* includes a pressing flag 30, the upper guide 31, a lower guide 32, an aligning unit 33, the discharge guide 34, a guide drive unit 35, first reference plates 39, the stapler 51, a second reference plate 52, a pressing guide 56, and a jogger 58. The upper guide 31 and the lower guide 32 form a sheet accommodating space on the inner sides of both guides for accommodating sheets to be processed by the post-processing unit 4*a*. A sheet discharged from the kick-out roller 29 is loaded onto the lower guide 32 in the sheet accommodating space. The pressing flag 30 is capable of pivoting on the downstream side of the kick-out roller 29. The pressing flag 30 presses a following edge part of a preceding sheet discharged into the sheet accommodating space such that a leading edge of the following discharged sheet passes above the preceding sheet. In other words, the pressing flag 30 prevents collisions between sheets discharged into the sheet accommodating space before and after each other. The lower surface of the pressing flag 30 is of a width sufficient to press the following edge parts of sheets of various sizes that can be processed by the post-processing unit 4*a*.

The aligning unit 33 is disposed on the upper guide 31, and the aligning unit 33 has a shaft 33*b* rotatably supported by the upper guide 31, an aligning roller 33*a* coupled to the shaft 33*b*, and a gear 33*c* for rotating the shaft 33*b*. The aligning roller 33*a* is formed from an elastic material (e.g., synthetic rubber or an elastomer resin), and has an outer circumferential surface that is semicircular when viewed from the axial direction. The gear 33*c* is driven intermittently by a drive unit (not shown) to rotate one revolution at a time in conjunction with the timing at which a sheet is discharged into the sheet accommodating space, and as a result, the shaft 33*b* and the aligning roller 33*a* also rotate. During this rotation, the aligning roller 33*a* abuts with the top surface of the uppermost sheet in the sheet accommodating space through an opening 31*a* in the upper guide 31, and transports that sheet toward the pair of first reference plates 39. When the sheet abuts with the first reference plates 39, the aligning roller 33*a* slips on the sheet surface and rotates further, separating from the sheet. The first reference plates 39 regulate the attitude of the sheet by abutting against the edge part of the sheet discharged into the sheet accommodating space at inner walls of the plates, which are orthogonal to the sheet transport direction and orthogonal to the top surface of the lower guide 32. The pressing guide 56 is a flexible plate-shaped member that presses down on the top surface of the sheet in the sheet accommodating space.

In the following descriptions, the direction in which the sheet moves toward the first reference plates 39 in the post-processing unit 4*a* will be called a longitudinal alignment direction X1. The direction opposite to the longitudinal alignment direction X1, i.e., the direction in which the sheet bundle leaves the first reference plates 39 and is discharged from the post-processing unit 4*a*, is the discharge direction X2. The lower guide 32, for example, has a width sufficient to accommodate an A4-size sheet transported through long-side feeding (an attitude in which the longer side is parallel to the longitudinal alignment direction X1). The second reference plate 52 is disposed on one side surface of the lower guide 32. The jogger 58 is disposed on another side surface of the lower guide 32. The jogger 58 is configured to be capable of moving in a width direction of the sheet. The jogger 58 and the second reference plate 52 abut against respective sides of the sheets discharged into the sheet accommodating space and regulates the attitude of the sheets in the width direction thereof.

The stapler 51 performs stapling processing for a sheet bundle aligned in both the longitudinal alignment direction X1 and the width direction in the sheet accommodating space. The stapler 51 may be configured to be capable of moving, for example, in the longitudinal alignment direction X1 and in the discharge direction X2. In this case, not only can corner stapling be used to staple the corner parts of a sheet bundle, but also longer side stapling can be used to staple a plurality of parts located along the longer side of a sheet bundle while moving relative to the bundle.

The discharge guide 34 is a transport unit configured to be capable of sliding in the discharge direction X2, and transports the sheet bundle processed by the post-processing unit 4*a* along the transport path and passes the sheet bundle to the discharge rollers 36 described above. An upper guide 59 guides the leading edge of the sheet bundle to a position between the roller pairs of the discharge rollers 36.

6. Example of Configuration of Control Functions

Figure 3:
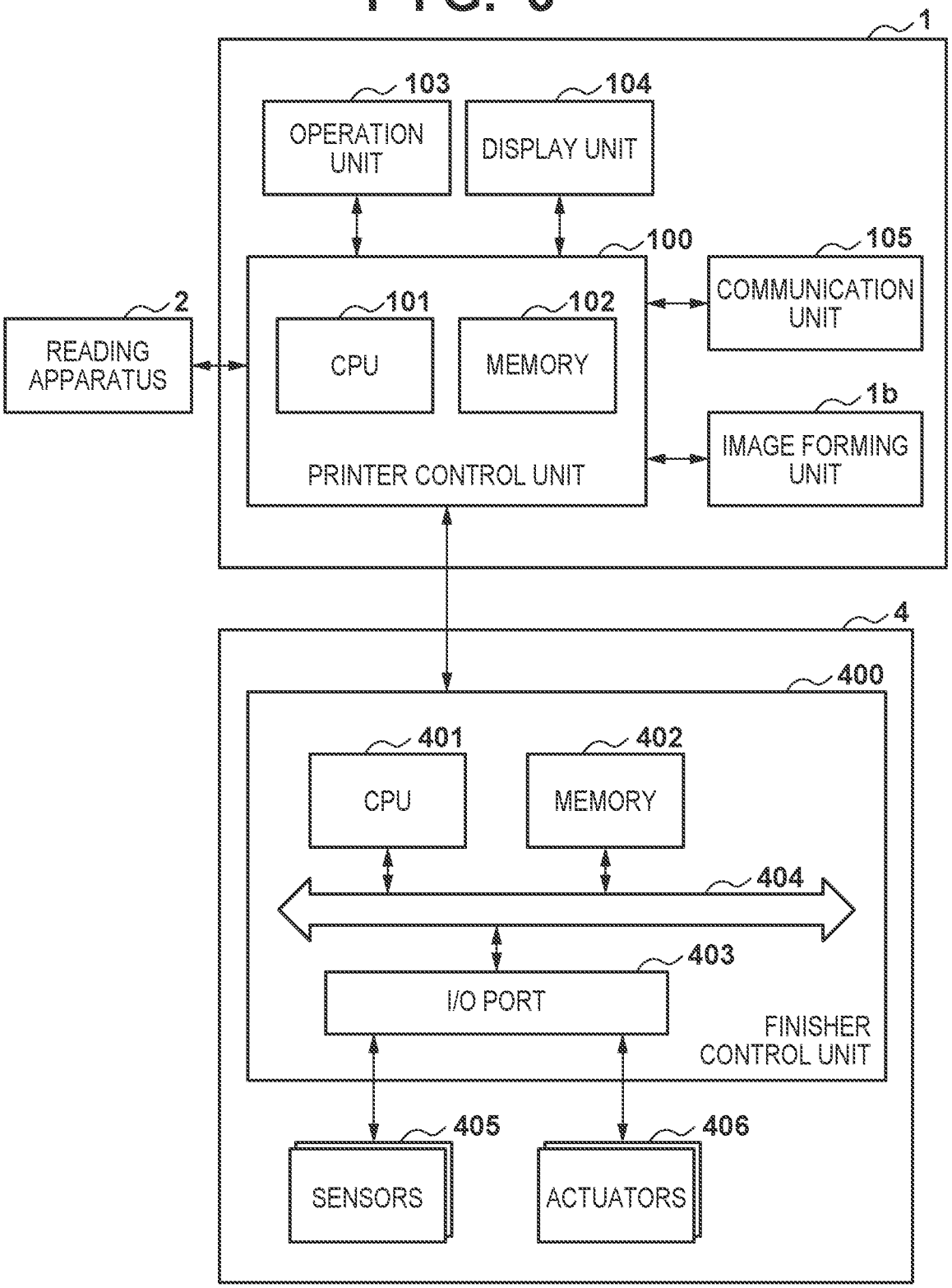
FIG. 3 is a block diagram illustrating an example of the configuration of control functions of the image forming system according to an embodiment.

FIG. 3 is a block diagram illustrating an example of the configuration of control functions of the image forming system 1*s*. Referring to FIG. 3, the image forming apparatus 1 includes a printer control unit 100, an operation unit 103, a display unit 104, and a communication unit 105, in addition to the image forming unit 1*b*. The printer control unit 100 includes a CPU 101 and a memory 102. The post-processing apparatus 4 includes a finisher control unit 400, sensors 405, and actuators 406. The finisher control unit 400 includes a CPU 401, a memory 402, an input/output (I/O) port 403, and a bus 404. The printer control unit 100 and the finisher control unit 400 are connected to each other over a control signal line and cooperate to control the operations of the image forming system 1*s*.

The CPU (Central Processing Unit) 101 of the printer control unit 100 controls the overall operations of the image forming apparatus 1 by executing computer programs stored in the memory 102. For example, when a copy job is instructed, the CPU 101 causes the reading apparatus 2 to read a document and controls the operations of the image forming unit 1*b* to form an image on a sheet based on the read image data input from the reading apparatus 2. When a print job is instructed, the CPU 101 controls the operations of the image forming unit 1*b* to form an image on a sheet based on input image data received from an external apparatus via the communication unit 105. The memory 102 may be any combination of Read-Only Memory (ROM), which is a non-volatile storage medium, and Random Access Memory (RAM), which is a volatile storage medium. The memory 102 stores at least one computer program executed by the CPU 101, image data, setting data, and other data. The memory 102 may include a non-transitory computer-readable storage medium.

The operation unit 103 is a device for accepting instructions and information input from a user of the image forming system 1*s*. The operation unit 103 may include, for example, one or more of a button, a touch panel, a switch, a keypad, and a microphone. The display unit 104 is a device for displaying information and images to a user of the image forming system 1*s*. The display unit 104 is a liquid crystal display, for example. The communication unit 105 is an interface that mediates communication by the image forming apparatus 1 with an external apparatus (e.g., a Personal Computer (PC) or a smartphone).

The CPU 401 of the finisher control unit 400 controls the overall operations of the post-processing apparatus 4 by executing computer programs stored in the memory 402. The memory 402 may be any combination of ROM and RAM. The memory 402 stores at least one computer program executed by the CPU 401, setting data, and other data. The memory 402 may include a non-transitory computer-readable storage medium. The CPU 401 and the memory 402 are connected to the I/O port 403 over the bus 404. The I/O port 403 accepts sensor signals from each of the plurality of sensors 405 provided in the post-processing apparatus 4. The plurality of sensors 405 can include, for example, the entrance sensor 27, the intermediate sensor 38, and the exit sensor 60. The I/O port 403 outputs control signals to the plurality of actuators 406 provided in the post-processing apparatus 4. The plurality of actuators 406 can include, for example, motors for rotating or moving the rollers, guides, stapler, and jogger of the above-described post-processing apparatus 4.

Each function of the printer control unit 100 and the finisher control unit 400 may be implemented by a dedicated hardware circuit such as an Application Specific Integrated Circuit (ASIC). Each function of the printer control unit 100 and the finisher control unit 400 may be implemented as software using a general-purpose processor such as the CPU described above. Furthermore, some or all of the functions of the finisher control unit 400 described in the present specification may be implemented as functions of the printer control unit 100.

7. Example of Configuration of Discharge Control Function

Figure 4:
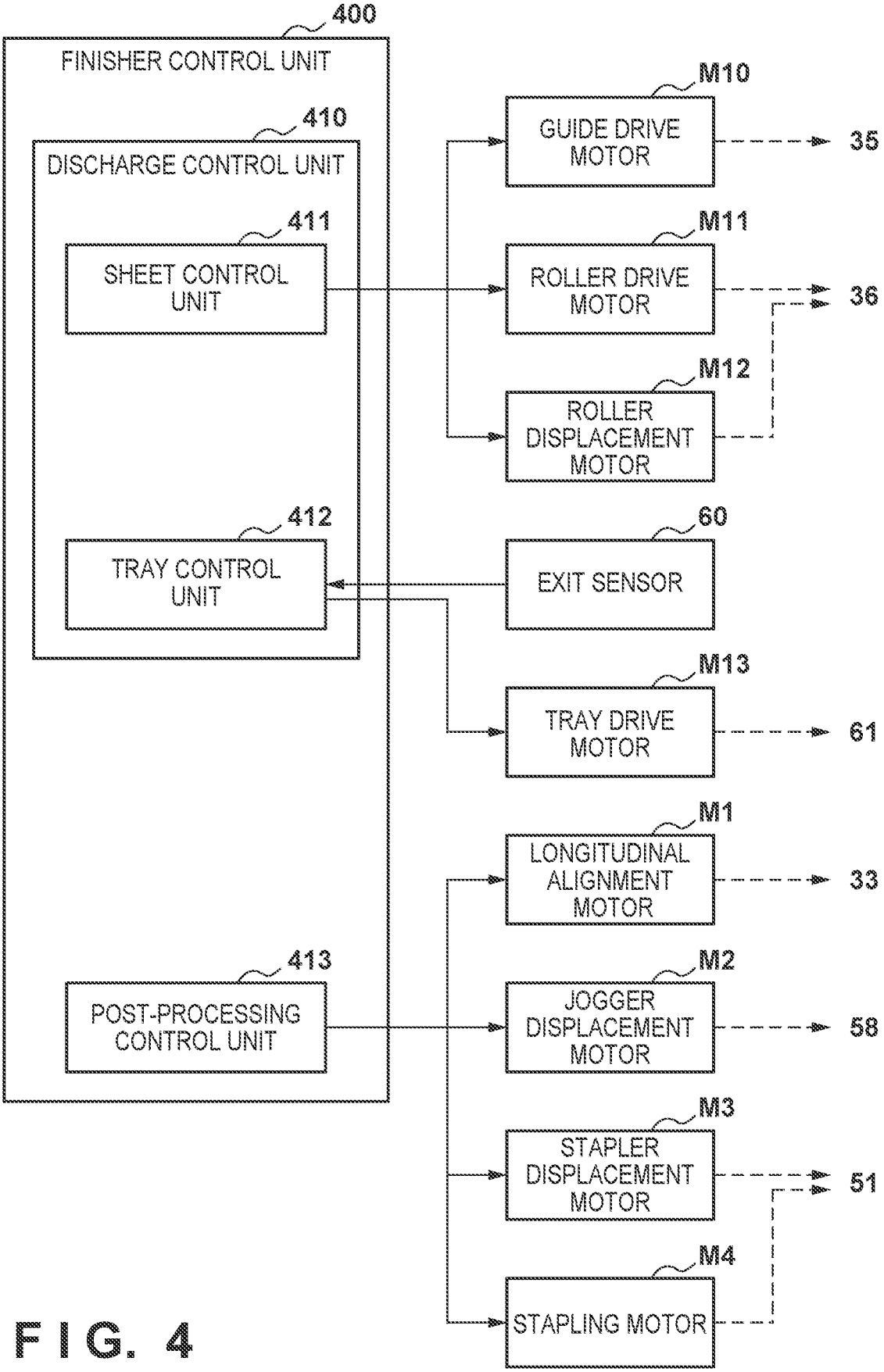
FIG. 4 is a block diagram illustrating, in detail, an example of configurations related to a discharge control function of the post-processing apparatus according to an embodiment.

FIG. 4 is a block diagram illustrating, in more detail, an example of the configurations related to a discharge control function of the finisher control unit 400 for controlling the discharge of sheets from the post-processing apparatus 4. Referring to FIG. 4, the finisher control unit 400 includes a discharge control unit 410 and a post-processing control unit 413. The discharge control unit 410 includes a sheet control unit 411 and a tray control unit 412.

The sheet control unit 411 rotates a guide drive motor M10, and the rotational force thereof causes the guide drive unit 35 to operate and slide the discharge guide 34 in the discharge direction X2. As a result, the sheet bundle loaded on the lower guide 32 moves in the discharge direction X2 to the position of the discharge rollers 36. The sheet control unit 411 rotates a roller drive motor M11, and the rotational force thereof causes the discharge rollers 36 to operate and discharge the sheet bundle that has been transported by the discharge guide 34 from the discharge port 70. When the sheet bundle has been discharged, the sheet control unit 411 operates the guide drive motor M10 in the reverse direction and causes the discharge guide 34 to slide in the longitudinal alignment direction X1, which returns the discharge guide 34 to its original standby position.

The sheet control unit 411 can cause the position of the discharge rollers 36 (e.g., an upper roller 36*a* and a lower roller 36*b*) to displace by rotating a roller displacement motor M12. For example, the sheet control unit 411 causes the discharge guide 34 to transport the sheet bundle to the position of the discharge rollers 36 with the upper roller 36*a* and the lower roller 36*b* sufficiently separated from each other. When the sheet bundle reaches the position of the discharge rollers 36, the sheet control unit 411 narrows the gap between the upper roller 36*a* and the lower roller 36*b* to pinch the sheet bundle. As a result, the sheet bundle is passed from the discharge guide 34 to the discharge rollers 36.

The tray control unit 412 controls the movement of the protrusible tray 61 such that the protrusible tray 61 reaches the position of the pressing member 62 after the sheet bundle abuts with the pressing member 62. More specifically, the tray control unit 412 controls the timing at which to cause the protrusible tray 61 to protrude from the retracted position based on the timing at which the exit sensor 60 detects the sheet bundle has reached the detection position of the exit sensor 60. For example, the tray control unit 412 monitors a sensor signal from the exit sensor 60, and then stands by for a given time duration once the leading edge of the sheet bundle transported by the discharge guide 34 is detected by the exit sensor 60. Then, after the time duration for standby has passed, the tray control unit 412 rotates a tray drive motor M13 to cause the protrusible tray 61 to protrude from the discharge port 70. When the following edge of the sheet bundle is then detected by the exit sensor 60, the tray control unit 412 operates the tray drive motor M13 in the reverse direction, and retracts the protrusible tray 61 to the original retracted position.

When sheets are discharged to the post-processing unit 4*a* by the kick-out roller 29, the post-processing control unit 413 causes a longitudinal alignment motor M1 to rotate, the rotational force of which causes the aligning roller 33*a* of the aligning unit 33 to rotate and align the sheet bundle in a length direction thereof. The post-processing control unit 413 also causes a jogger displacement motor M2 to rotate, and by moving the jogger 58 toward a position corresponding to the size of the sheets in the width direction, the sheet bundle is aligned in the width direction thereof. The post-processing control unit 413 can further cause a stapler displacement motor M3 and a stapling motor M4 to rotate according to post-processing settings in the job received from the printer control unit 100. The stapler displacement motor M3 causes the stapler 51 to move in the longitudinal alignment direction X1 or the discharge direction X2. The stapling motor M4 causes the stapler 51, which has moved to a target position, to perform operations for stapling the sheet bundle.

8. Operations of Bundle Discharge Unit

Figure 5A:
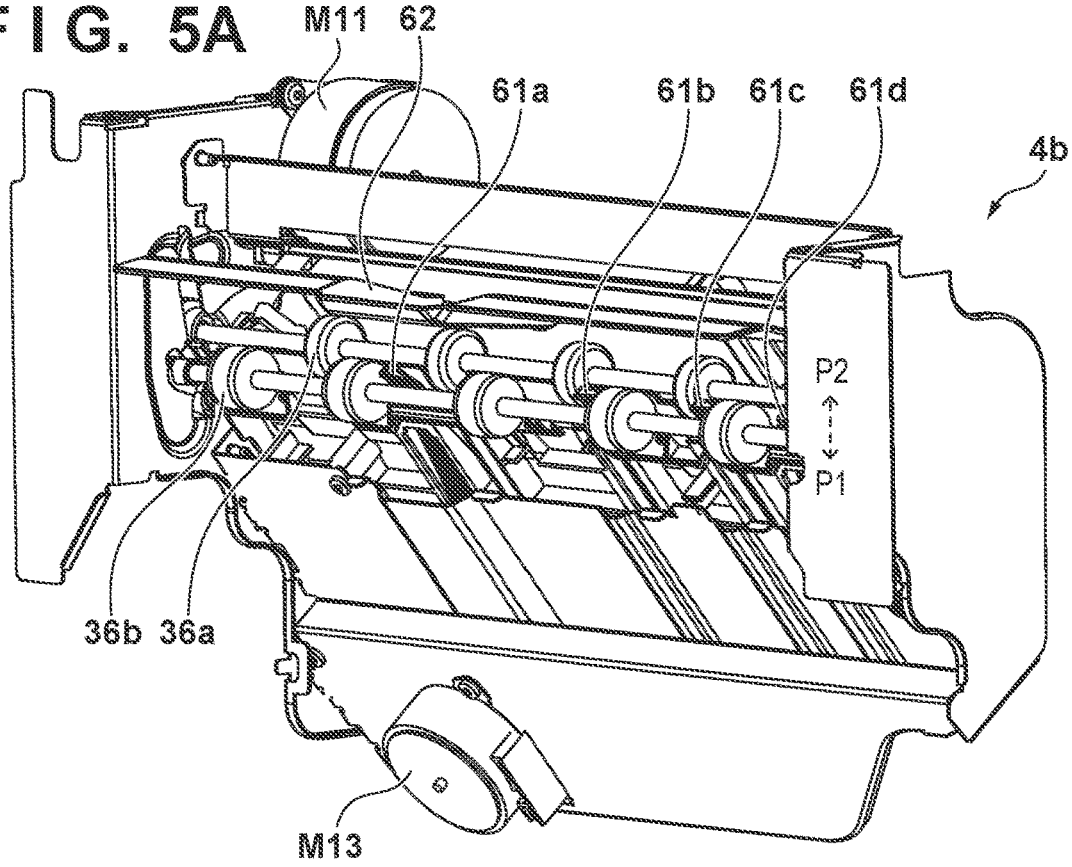
FIG. 5A is a perspective view illustrating, in detail, members of a bundle discharge unit when a protrusible tray is in a retracted position.
Figure 5B:
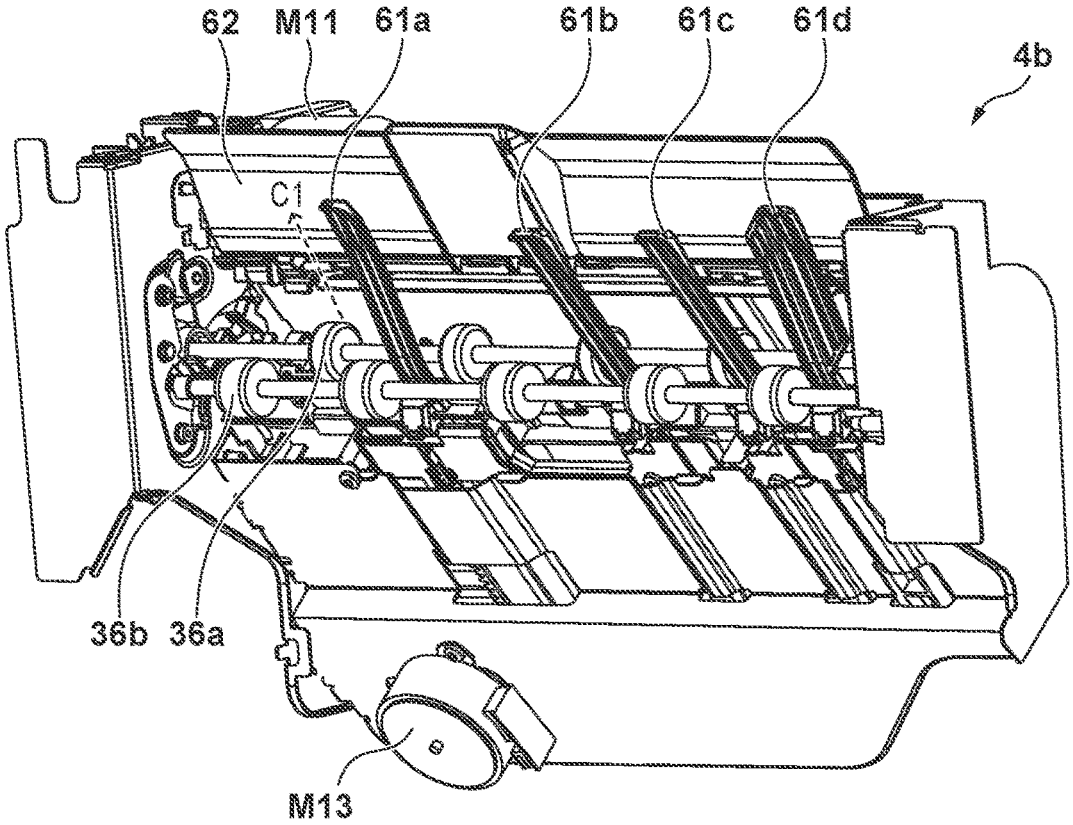
FIG. 5B is a perspective view illustrating, in detail, members of a bundle discharge unit when a protrusible tray is in a protruding position.
Figure 6A:
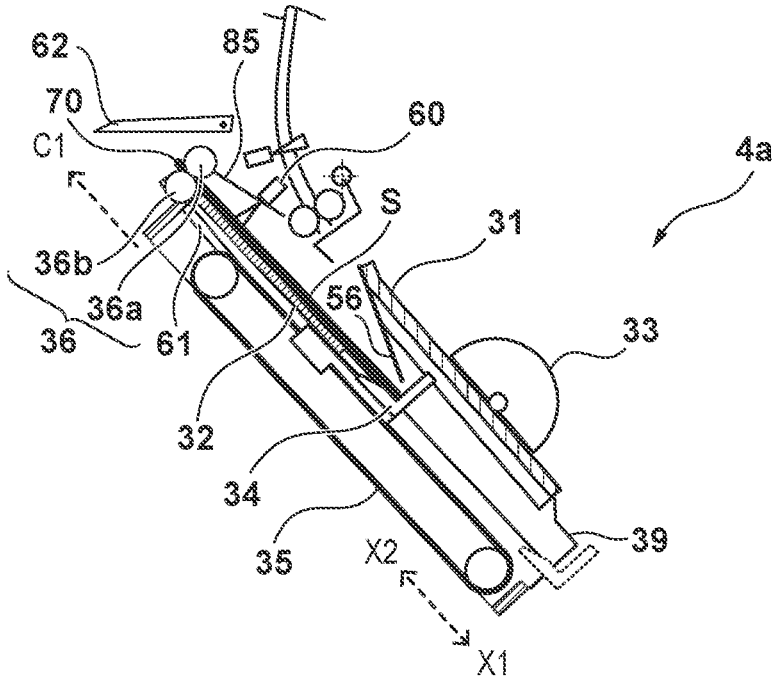
FIG. 6A is a schematic cross-sectional view illustrating a positional relationship between the main members of the bundle discharge unit and a sheet when the protrusible tray is in the retracted position.
Figure 6B:
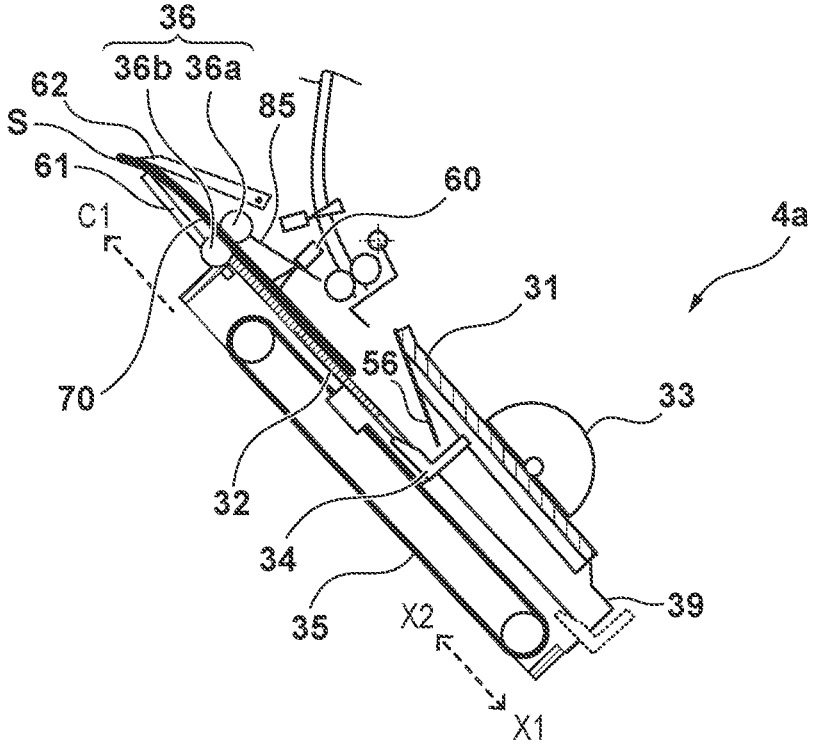
FIG. 6B is a schematic cross-sectional view illustrating a positional relationship between the main members of the bundle discharge unit and a sheet when the protrusible tray is in the protruding position.

FIGS. 5A and 5B are perspective views illustrating members constituting the bundle discharge unit 4*b* in detail. FIG. 5A illustrates the members of the bundle discharge unit 4*b* when the protrusible tray 61 is in the retracted position, and FIG. 5B illustrates the members of the bundle discharge unit 4*b* when the protrusible tray 61 is in the protruding position. In these drawings, some members, such as the sheet bundle and a frame body of the bundle discharge unit 4*b*, are omitted such that more detail can be shown. FIGS. 6A and 6B are schematic cross-sectional views, seen in the width direction of the sheets, which illustrate positional relationships between the main members of the bundle discharge unit 4*b* and the sheets. FIG. 6A illustrates the positional relationships when the protrusible tray 61 is in the retracted position, and FIG. 6B illustrates the positional relationship when the protrusible tray 61 is in the protruding position.

As described above, after a sheet bundle S has been aligned or stapled in the post-processing unit 4*a*, the sheet control unit 411 causes the guide drive motor M10 to rotate, operates the guide drive unit 35, and causes the discharge guide 34 to slide in the discharge direction X2. The sheet bundle S, which has had the following edge pushed by the discharge guide 34, is pushed outward in the discharge direction X2, and the leading edge of the sheet bundle S is guided by the upper guide 59 and reaches the position of the discharge rollers 36 (a position d2, described later). At this time, the upper roller 36*a* and the lower roller 36*b*, which constitute the discharge rollers 36, are separated from each other.

When the exit sensor 60 detects the leading edge of the sheet bundle S at the detection position immediately before the leading edge of the sheet bundle S reaches the position of the discharge rollers 36, the discharge control unit 410 starts preparations for causing the protrusible tray 61 to protrude. The sheet control unit 411 causes the roller displacement motor M12 to rotate and move the upper roller 36*a* in a direction P1, which causes the upper roller 36*a* and the lower roller 36*b* to pinch the sheet bundle S (see FIGS. 5A and 6A). Next, when the sheet control unit 411 causes the roller drive motor M11, the discharge rollers 36 driven by the roller drive motor M11 rotate and discharge the sheet bundle S to the exterior from the discharge port 70 while pinching that sheet bundle S. When the leading edge of the sheet bundle S reaches the pressing member 62, the pressing member 62 is pushed up and pivoted.

In the example illustrated in FIGS. 5A and 5B, the protrusible tray 61 has four comb teeth 61*a*, 61*b*, 61*c*, and 61*d*. The protrusible tray 61 is driven by the tray drive motor M13 under the control of the tray control unit 412, and starts moving in the direction C1. Tips of the comb teeth of the protrusible tray 61 reach the position of the pressing member 62 slightly later than the leading edge of the sheet bundle S (see FIGS. 5B and 6B). The protrusible tray 61 supports the sheet bundle S from the underside thereof while the protrusible tray 61 is protruding from the discharge port 70.

When the following edge of the sheet bundle S is detected by the exit sensor 60, the tray control unit 412 causes the tray drive motor M13 to rotate in reverse, and starts retracting the protrusible tray 61. As the protrusible tray 61 retracts, the sheet bundle S loses support from the protrusible tray 61 and is discharged to the lower discharge tray 37. When the following edge of the sheet bundle S passes the position of the discharge rollers 36, the pressing member 62, which has been pushed upward by the sheet bundle S, returns to its original position while pressing the top surface of the sheet bundle S near the following edge thereof. The sheet control unit 411 can cause the roller displacement motor M12 to rotate in reverse and move the upper roller 36*a* in a direction P2, and as a result, the upper roller 36*a* and the lower roller 36*b* separate again. The sheet control unit 411 causes the discharge guide 34 to slide in the longitudinal alignment direction X1 and return to its original standby position. In this manner, the post-processing unit 4*a* enters a state of being capable of accepting the next sheet.

9. Flow of Processing

Figure 7:
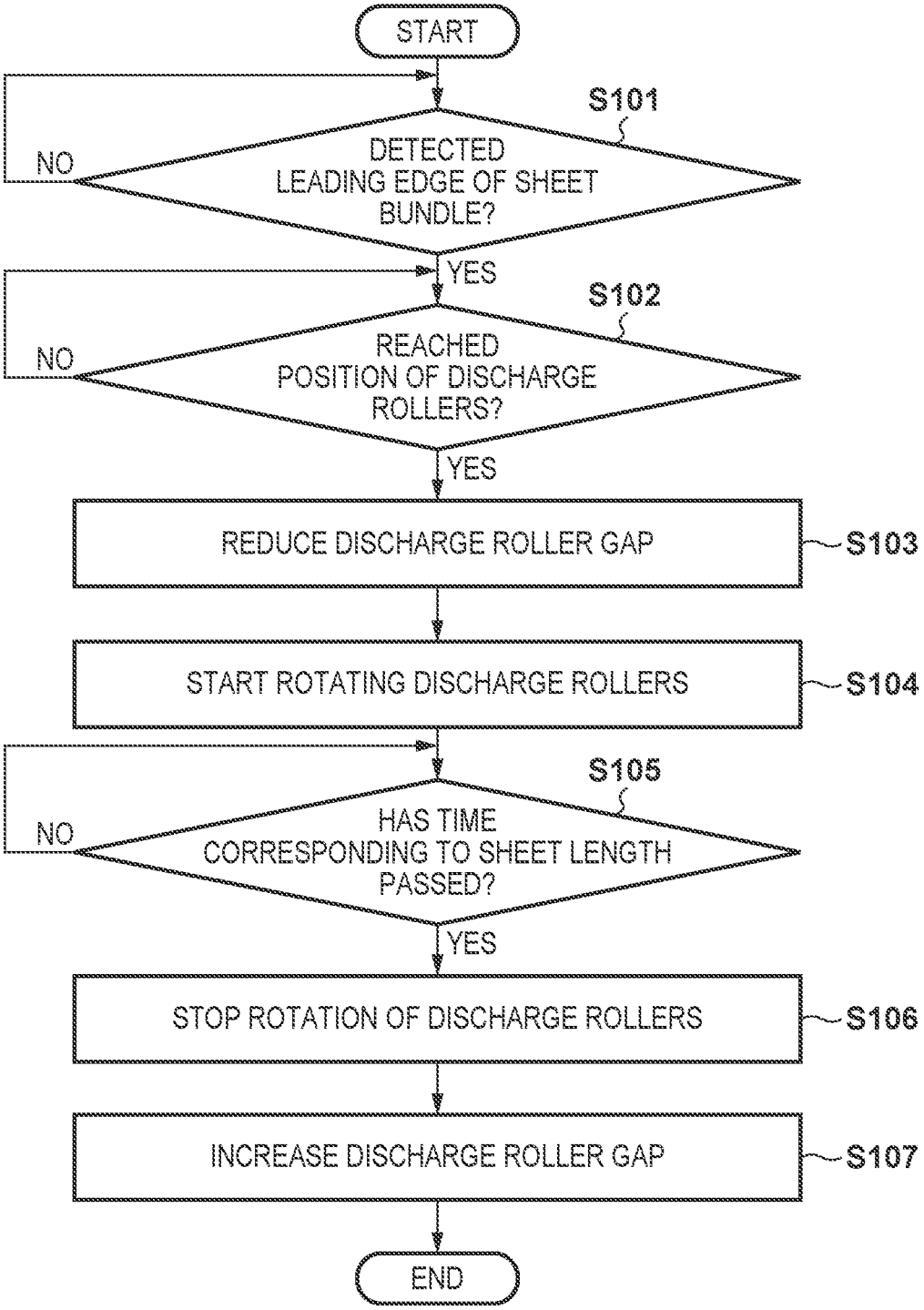
FIG. 7 is a flowchart illustrating an example of the flow of transport control processing according to an embodiment.
Figure 8:
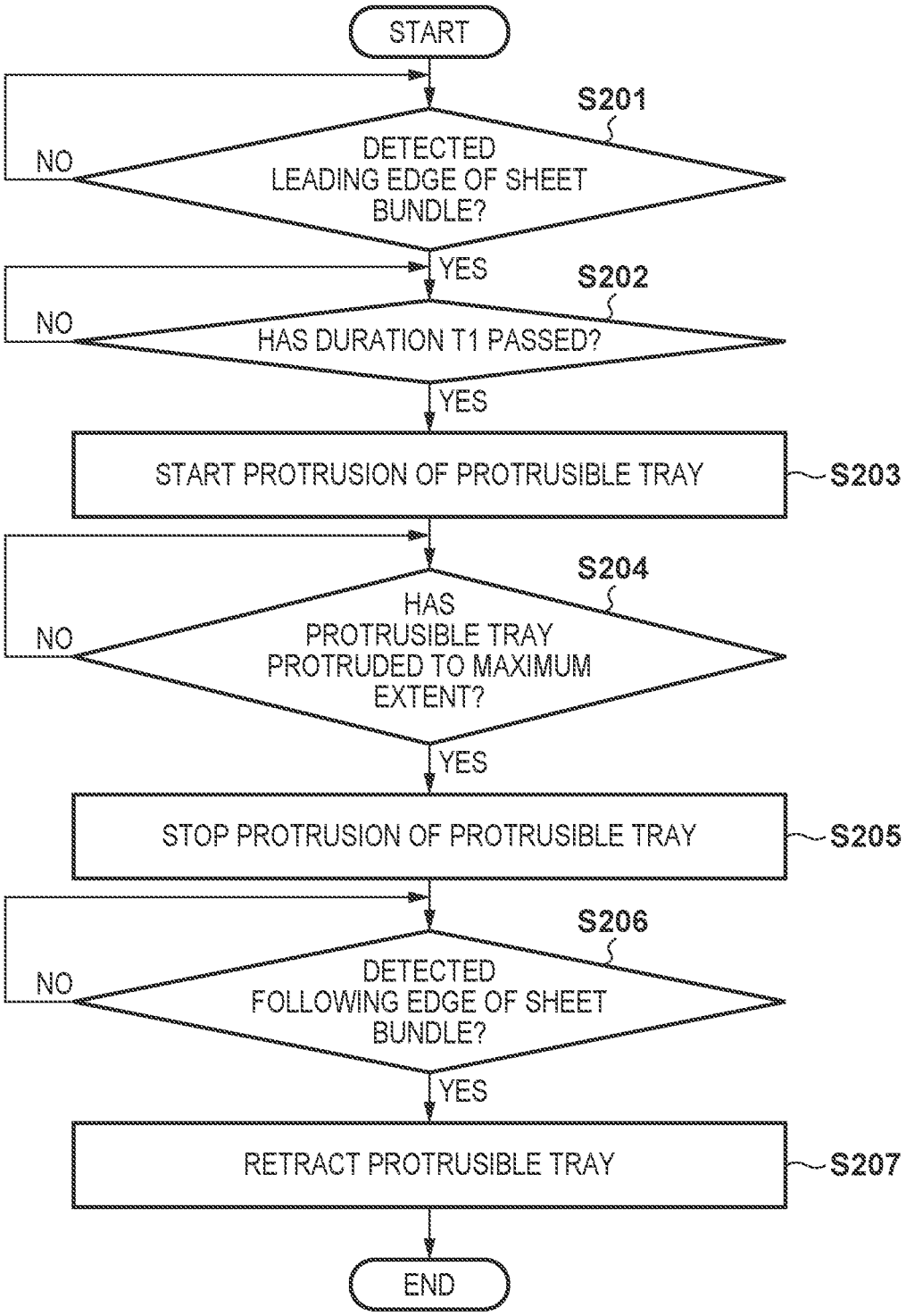
FIG. 8 is a flowchart illustrating an example of the flow of protrusion control processing according to an embodiment.

FIG. 7 is a flowchart illustrating an example of the flow of transport control processing performed by the sheet control unit 411 according to the present embodiment. FIG. 8 is a flowchart illustrating an example of the flow of protrusion control processing performed by the tray control unit 412 according to the present embodiment. The transport control processing and the protrusion control processing are performed in parallel after a bundle of sheets has been aligned or stapled by the post-processing unit 4*a*. Note that in the following descriptions, the processing steps are indicated by an S, indicating "step".

9-1. Transport Control Processing

In the transport control processing in FIG. 7, first, in step S101, the sheet control unit 411 stands by until the exit sensor 60 detects the leading edge of the sheet bundle S. The sequence moves to step S102 when the leading edge of the sheet bundle S is detected. In step S102, the sheet control unit 411 stands by until the sheet bundle S reaches the position of the discharge rollers 36 (the position when the upper roller 36*a* and the lower roller 36*b* can pinch the sheet bundle S). The sequence moves to step S103 when the sheet bundle S reaches the position of the discharge rollers 36. In step S103, the sheet control unit 411 causes the discharge rollers 36 to pinch the sheet bundle S by reducing the gap between the upper roller 36*a* and the lower roller 36*b* of the discharge rollers 36. Next, in step S104, the sheet control unit 411 starts rotating the discharge rollers 36. The sheet bundle S is discharged at a speed based on the rotation speed of the discharge rollers 36. Next, in step S105, while rotating the discharge rollers 36, the sheet control unit 411 stands by until a period of time corresponding to the length of a sheet passes (i.e., until the sheet bundle S separates from the discharge rollers 36). The sequence moves to step S106 once the period of time corresponding to the length of the sheet has passed. In step S106, the sheet control unit 411 stops rotating the discharge rollers 36. Next, in step S107, the sheet control unit 411 increases the gap between the upper roller 36*a* and the lower roller 36*b* of the discharge rollers 36 and returns the gap to its original size.

9.2 Protrusion Control Processing

In the protrusion control processing in FIG. 8, first, in step S201, the tray control unit 412 stands by until the exit sensor 60 detects the leading edge of the sheet bundle S. The sequence moves to step S202 when the leading edge of the sheet bundle S is detected. In step S202, the tray control unit 412 stands by until a predetermined time duration T1 passes. The time duration T1 will be described further later. The sequence moves to step S203 once the time duration T1 has passed. In step S203, the tray control unit 412 causes the protrusible tray 61 to start protruding from the retracted position. Next, in step S204, while causing the protrusible tray 61 to protrude, the tray control unit 412 stands by until the protrusible tray 61 protrudes to the maximum extent. The sequence moves to step S205 once the protrusible tray 61 has protruded to the maximum extent. In step S205, the tray control unit 412 causes the protrusible tray 61 to stop protruding. Next, in step S206, the tray control unit 412 stands by until the exit sensor 60 detects the following edge of the sheet bundle S. The sequence moves to step S207 when the following edge of the sheet bundle S is detected. In step S207, the tray control unit 412 causes the protrusible tray 61 to retract from the protruding position to the original retracted position.

9-3. Timing of Protrusion of Protrusible Tray

Figure 10:
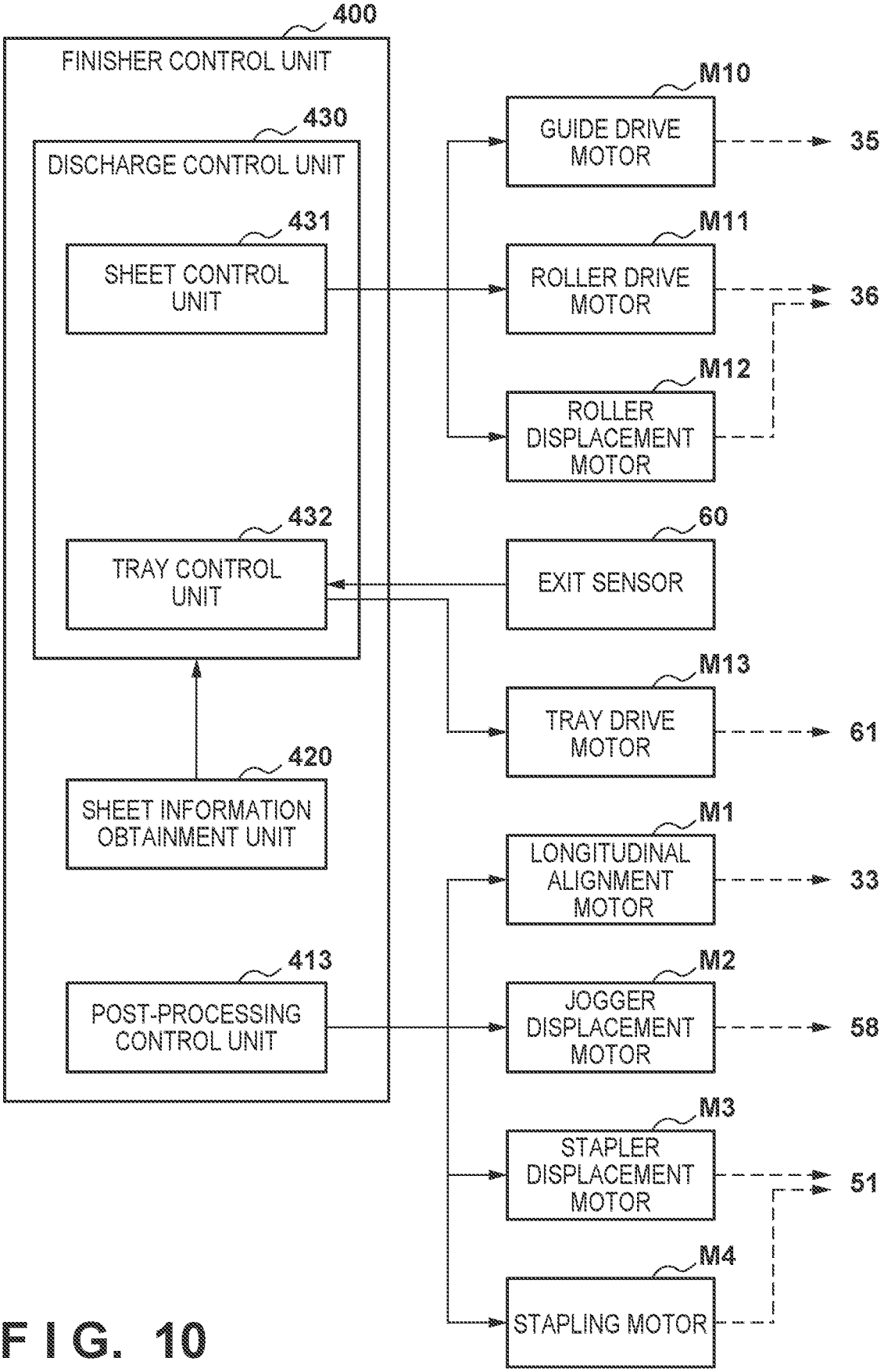
FIG. 10 is a block diagram illustrating, in detail, an example of configurations related to a discharge control function of the post-processing apparatus according to a first variation.

FIG. 10 is a timing chart illustrating the timing of the protrusion of the protrusible tray 61, along with the positional relationship between the protrusible tray 61 and the sheet bundle. The horizontal axis in FIG. 10 represents the passage of time from when the discharge guide 34 starts discharging the sheet bundle in the discharge direction X2. The vertical axis represents a distance, in the discharge direction X2, from a position d0 of the leading edge of the sheet bundle at an elapsed time of zero (a discharge start position). A solid line graph 91 represents the position of the leading edge of the sheet bundle, which changes with time. A broken line graph 92 represents the position of the leading edge of the protrusible tray 61, which changes with time. It is assumed that at an elapsed time of zero, the protrusible tray 61 is standing by at the retracted position and the leading edge of the protrusible tray 61 is at the position D1.

The leading edge of the sheet bundle, which is pushed by the discharge guide 34 and has started moving, reaches the detection position d1 of the exit sensor 60 at time t1. The discharge control unit 410, for example, starts a timer at this point in time, and starts monitoring the passage of time. At time t2, the leading edge of the sheet bundle reaches the position d2 at which the discharge rollers 36 can pinch the sheet bundle. The sheet control unit 411 can determine that the leading edge of the sheet bundle has reached the position d2 based on the timer measuring a time duration T2(=t2−t1). From time t2 to time t3, the discharge guide 34 stops operating and the position of the leading edge of the sheet bundle stays at the position d2. During this time, the gap between the upper roller 36*a* and the lower roller 36*b* of the discharge rollers 36 is reduced, and the sheet bundle is pinched by those rollers. At time t3, the discharge rollers 36 start rotating, and the leading edge of the sheet bundle once again moves in the discharge direction X2. At time t4, the tray control unit 412 causes the protrusible tray 61 to start protruding. The tray control unit 412 can determine the timing at which the protrusible tray 61 is to start protruding based on, for example, the timer measuring the time duration T1(=t4−t1). At time t5, the leading edge of the sheet bundle reaches the position d3 of abutment with the pressing member 62. At this time, the leading edge of the protrusible tray 61 is positioned behind the leading edge of the sheet bundle by a distance L1. At time t6, the leading edge of the protrusible tray 61 reaches the maximum protruding position D2, whereupon the protrusible tray 61 stops. The tray control unit 412 can determine the timing at which the protrusible tray 61 is to stop based on, for example, the timer measuring a time duration T3(=t6−t1). At time t7, the following edge of the sheet bundle reaches the position d1. A length Ls indicated in the drawings corresponds to the length of the sheet. When the following edge of the sheet bundle is detected by the exit sensor 60 at time t7, the tray control unit 412 causes the protrusible tray 61 to start retracting.

In one example, the movement speed of the discharge guide 34 (the transport speed of the sheet bundle up to time t2) and the speed at which the sheet bundle is discharged by the discharge rollers 36 (the discharge speed of the sheet bundle from time t3 on) may both be 200 mm/s. When the distance between the detection position d1 of the exit sensor 60 and the position d2 of the discharge rollers 36 is 20 mm, the time duration T2 is 100 milliseconds (ms). The time duration for which the discharge of the sheet bundle is stopped (t3−t2) depends on the speed of the displacement of the upper roller 36*a* and the lower roller 36*b*, and can be 300 ms, for example. When the distance between the position d2 of the discharge rollers 36 and the position d3 of the pressing member 62 is 20 mm, the leading edge of the sheet bundle reaches the position d3 of the pressing member 62 at time t5, which is 100 ms after movement is resumed at time t3.

The protrusion speed of the protrusible tray 61 may be 200 mm/s. Setting the protrusion speed of the protrusible tray 61 to the same value as the discharge speed of the sheet bundle makes it possible to stably support the sheet bundle while the protrusible tray 61 is protruding. A timing t4 at which the protrusible tray 61 starts protruding depends on the distance L1 between the leading edge of the sheet bundle and the leading edge of the protrusible tray 61, and the position D1 of the leading edge of the protrusible tray 61 at the retracted position. For example, in the example described above, L1=10 mm, and T1(=t4−t1)=450 ms.

Figure 9:
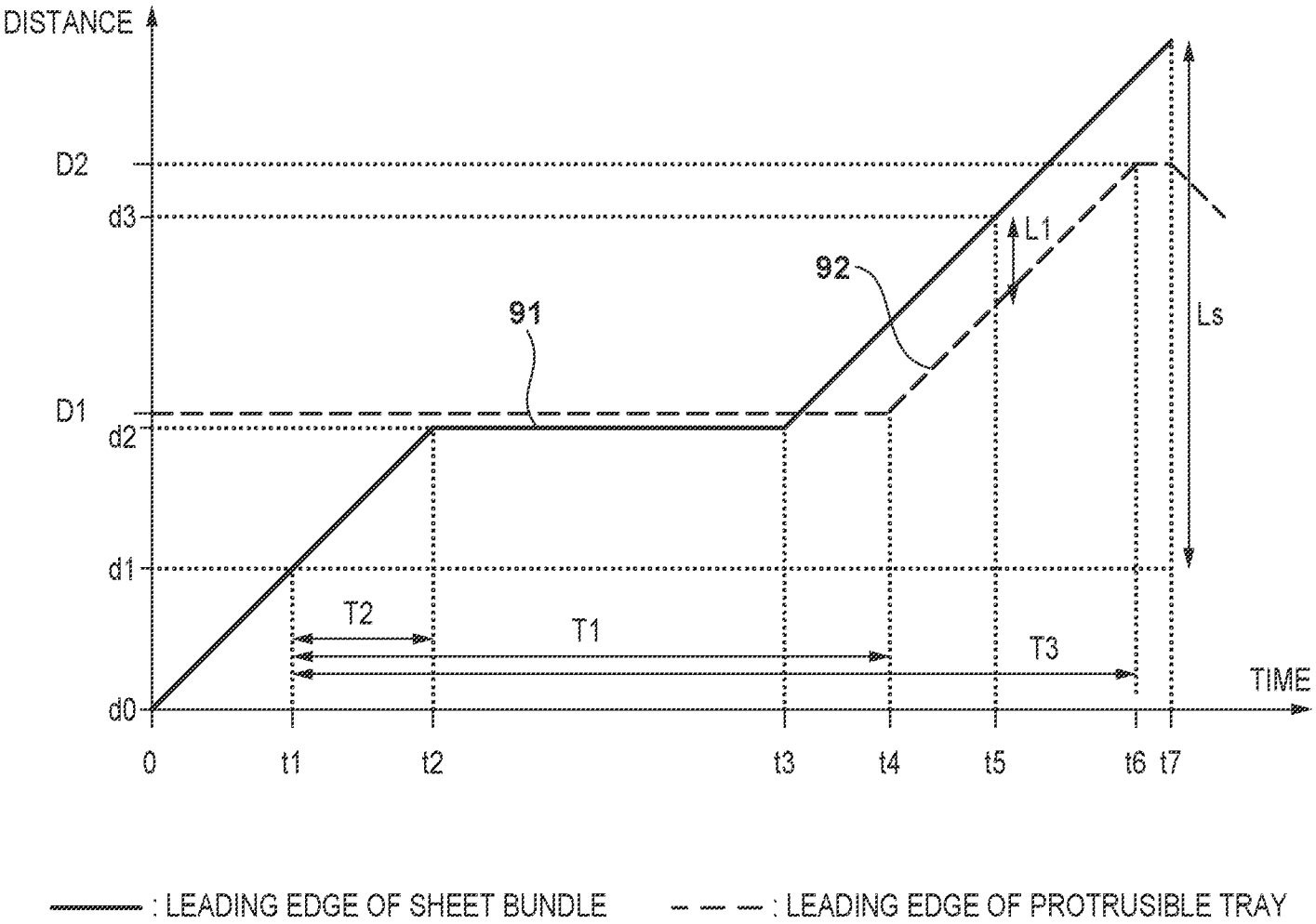
FIG. 9 is a timing chart illustrating the timing of protrusion of the protrusible tray.

According to the timing control described with reference to FIGS. 7 to 9, the sheet bundle reaches the position d3 of the pressing member 62 before the protrusible tray 61 and pushes the pressing member 62 upward, and the protrusible tray 61 will therefore not collide directly with the pressing member 62. As such, collision sounds caused by the protrusible tray 61 and the pressing member 62 colliding with each other are reduced. Additionally, the top surface of the sheet bundle is pressed by the pressing member 62 while the lower surface is supported by the protrusible tray 61 until the sheet bundle is sufficiently discharged from the discharge port 70, which improves the alignment of the sheet bundle. In this manner, according to the present embodiment, an improvement in sheet alignment from using both the pressing member 62 and the protrusible tray 61, and a reduction in collision sounds caused by those members colliding with each other, can both be achieved.

10. Variations

The previous section described an example in which the discharge speed of the sheet bundle and the protrusion speed of the protrusible tray 61 were both constant. However, these speeds may be changed during discharge. The protrusion speed of the protrusible tray 61 may be different from the discharge speed of the sheet bundle. The finisher control unit 400 of the post-processing apparatus 4 may set one or both of the discharge speed of the sheet bundle and the protrusion speed of the protrusible tray 61 in a variable manner. Additionally, the finisher control unit 400 may set the timing at which the protrusible tray 61 starts protruding from the retracted position in a variable manner as well. Two variations related to such control will be described hereinafter.

10-1. First Variation

In a first variation, the finisher control unit 400 sets the discharge speed, at which the discharge rollers 36 discharge the sheet bundle, in a variable manner. More specifically, the finisher control unit 400 sets the discharge speed of the sheet bundle to one of at least two candidate speeds based on the type of the sheets contained in the sheet bundle. Assume, for example, that one type of sheet is plain paper, and another type of sheet is heavy paper, which is thicker than plain paper. Compared to a sheet bundle constituted by plain paper, a sheet bundle constituted by heavy paper has a property of producing louder collision sounds when colliding with the pressing member 62. Accordingly, when a sheet bundle constituted by heavy paper is discharged, collision sounds are reduced by the finisher control unit 400 setting the discharge speed at which the sheet bundle collides with the pressing member 62 to a slower speed (a second speed V2) than the normal discharge speed (a first speed V1). In this case too, the movement of the protrusible tray 61 is controlled such that the protrusible tray 61 reaches the position of the pressing member 62 after the sheet bundle abuts with the pressing member 62.

In the present variation, the configurations of the image forming system 1*s*, the image forming apparatus 1, the reading apparatus 2, and the post-processing apparatus 4 may be the same as the configurations described above, with the exception of parts related to the discharge control function of the post-processing apparatus 4, illustrated in FIG. 10.

FIG. 10 is a block diagram illustrating, in further detail, an example of configurations related to the discharge control function of the post-processing apparatus 4 according to the present variation. Referring to FIG. 10, the finisher control unit 400 of the post-processing apparatus 4 includes the post-processing control unit 413, a sheet information obtainment unit 420, and a discharge control unit 430. The discharge control unit 430 includes a sheet control unit 431 and a tray control unit 432.

The sheet information obtainment unit 420 obtains, from the printer control unit 100 of the image forming apparatus 1, type information indicating a type of the sheet passed from the image forming apparatus 1 to the post-processing apparatus 4. As one example, the type information may be an identifier or a name identifying the type, such as "plain paper" and "heavy paper". As another example, the type information may be a numerical value indicating a characteristic value, such as the thickness or basis weight of the sheet. The printer control unit 100 may accept a designation of the sheet type from a user through the operation unit 103 and output type information indicating the accepted type to the sheet information obtainment unit 420. Alternatively, the image forming apparatus 1 or the post-processing apparatus 4 may include a sensor for automatically measuring the thickness or basis weight of the sheet, and the sheet information obtainment unit 420 may determine the type of the sheet based on sensor data from that sensor. The sheet information obtainment unit 420 outputs the obtained type information to the discharge control unit 430.

Like the above-described sheet control unit 411, the sheet control unit 431 controls the discharge guide 34 to transport a sheet bundle, which has been loaded onto the lower guide 32 of the post-processing unit 4*a*, to the position of the discharge rollers 36. When the sheet bundle reaches the position of the discharge rollers 36, the sheet control unit 431 narrows the gap between the upper roller 36*a* and the lower roller 36*b* to pinch the sheet bundle.

In the present variation, the sheet control unit 431 sets the discharge speed at which the sheet bundle is discharged from the discharge port 70 based on the type information input from the sheet information obtainment unit 420. For example, when the type information indicates that the type of the sheets constituting the sheet bundle is "plain paper", the sheet control unit 431 sets the discharge speed to the first speed V1. On the other hand, when the type information indicates that the type of the sheets constituting the sheet bundle is "heavy paper", the sheet control unit 431 sets the discharge speed to the second speed V2, which is slower than the first speed V1. The sheet control unit 431 causes the roller drive motor M11 to rotate at a rotation speed corresponding to the set discharge speed, whereupon the upper roller 36*a* and the lower roller 36*b* of the discharge rollers 36 are rotated by that rotational force, and the sheet bundle is discharged from the discharge port 70. If the type of the sheet is "heavy paper", when the leading edge of the sheet bundle reaches the position of the pressing member 62, the sheet control unit 431 may compensate for a relative delay in the discharge of the sheet bundle by setting the discharge speed to a third speed V3 that is faster than the second speed V2. In this case, the third speed V3 may be faster than the first speed V1.

In the present variation, similar to the tray control unit 412 described above, the tray control unit 432 monitors the sensor signal from the exit sensor 60. The tray control unit 432 stands by for a given time duration after the exit sensor 60 detects the leading edge of the sheet bundle transported by the discharge guide 34, and then causes the protrusible tray 61 to start protruding from the retracted position. The standby time duration before the protrusible tray 61 starts protruding may be fixed regardless of the type information input from the sheet information obtainment unit 420. However, the tray control unit 432 may instead set the standby time duration, before the protrusible tray 61 starts protruding, in a variable manner based on the type information input from the sheet information obtainment unit 420. For example, when the type information indicates that the type of the sheets constituting the sheet bundle is "plain paper", the tray control unit 432 sets the standby time duration to a first value T1. On the other hand, when the type information indicates that the type of the sheets constituting the sheet bundle is "heavy paper", the tray control unit 432 sets the standby time duration to a second value T1*b* that is greater than the first value T1. The protrusion speed of the protrusible tray 61 in the present variation may be fixed regardless of the type information input from the sheet information obtainment unit 420, and may be equivalent to the aforementioned first speed V1, for example. When the following edge of the sheet bundle is detected by the exit sensor 60, the tray control unit 432 causes the protrusible tray 61 to retract to the original retracted position.

Figure 11:
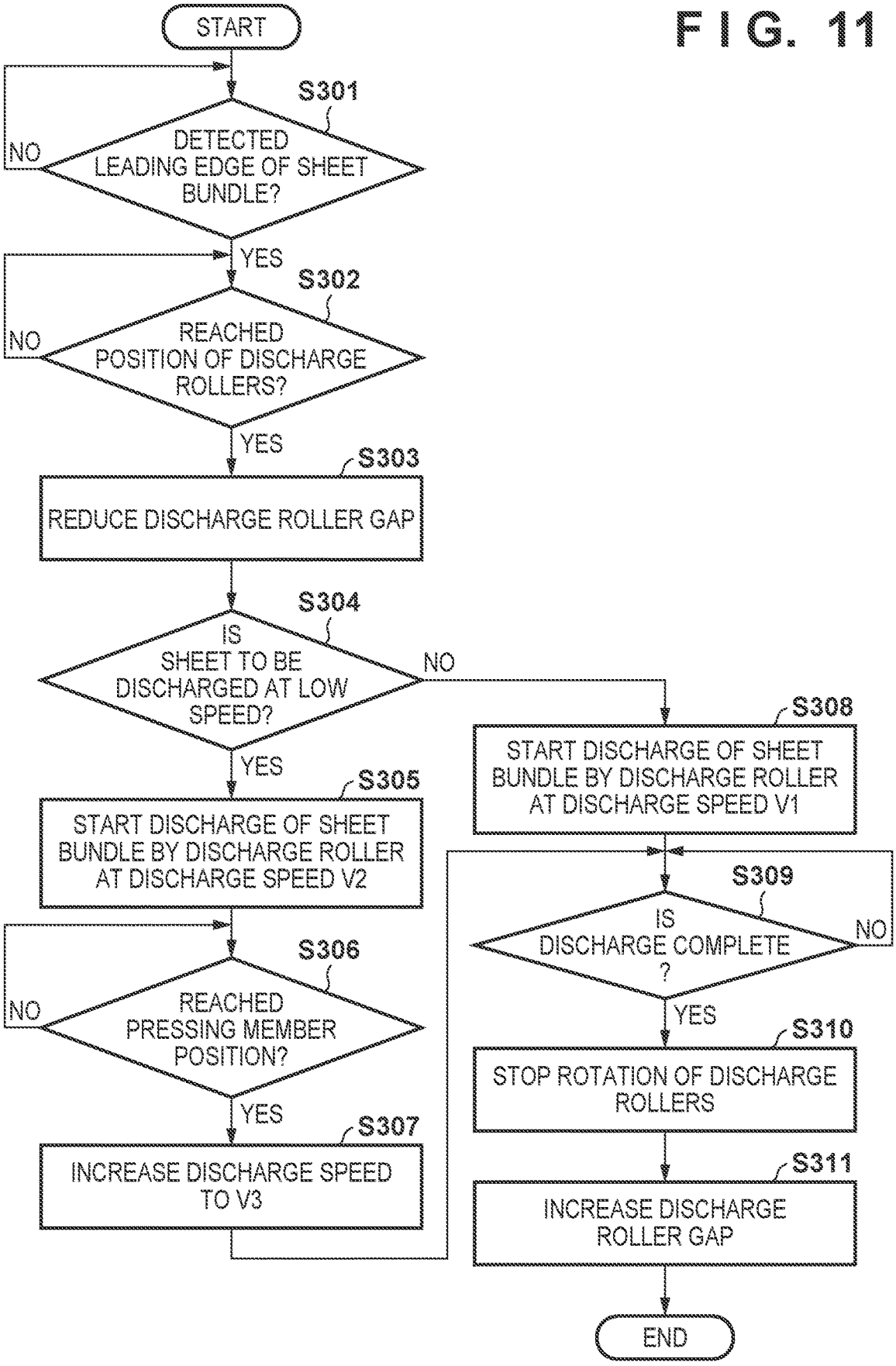
FIG. 11 is a flowchart illustrating an example of the flow of transport control processing according to the first variation.

FIG. 11 is a flowchart illustrating an example of the flow of transport control processing performed by the sheet control unit 431 according to the present variation. Referring to FIG. 11, first, in step S301, the sheet control unit 431 stands by until the exit sensor 60 detects the leading edge of the sheet bundle. The sequence moves to step S302 when the leading edge of the sheet bundle is detected. In step S302, the sheet control unit 431 stands by until the sheet bundle reaches the position of the discharge rollers 36. The sequence moves to step S303 when the sheet bundle reaches the position of the discharge rollers 36. In step S303, the sheet control unit 431 causes the discharge rollers 36 to pinch the sheet bundle by reducing the gap between the upper roller 36*a* and the lower roller 36*b* of the discharge rollers 36. The processing that follows thereafter branches depending on the type of the sheet indicated by the type information obtained by the sheet information obtainment unit 420. The sequence moves to step S305 if the type information indicates a sheet that is to be discharged at a low speed (e.g., "heavy paper"). The sequence moves to step S308 if the type information does not indicate a sheet that is to be discharged at the low speed.

In step S305, the sheet control unit 431 sets the rotation speed of the discharge rollers 36 to a speed corresponding to the discharge speed V2, and then causes the discharge rollers 36 to start rotating. The discharge of the sheet bundle is started at the discharge speed V2 as a result. Next, in step S306, the sheet control unit 431 stands by until the leading edge of the sheet bundle reaches the position of the pressing member 62, while continuing to discharge the sheet bundle. The sequence moves to step S307 when the leading edge of the sheet bundle reaches the position of the pressing member 62. In step S307, the sheet control unit 431 raises the rotation speed of the discharge rollers 36 to a speed corresponding to the discharge speed V3, which is faster than the discharge speed V2.

In step S308, the sheet control unit 431 sets the rotation speed of the discharge rollers 36 to a speed corresponding to the discharge speed V1, and then causes the discharge rollers 36 to start rotating. The discharge of the sheet bundle is started at the discharge speed V1 as a result.

Next, in step S309, while continuing to discharge the sheet bundle, the sheet control unit 431 stands by until the sheet bundle is released from the discharge rollers 36. The sequence moves to step S310 once the sheet bundle is released from the discharge rollers 36. In step S310, the sheet control unit 431 stops rotating the discharge rollers 36. Next, in step S311, the sheet control unit 431 increases the gap between the upper roller 36*a* and the lower roller 36*b* of the discharge rollers 36 and returns the gap to its original size.

Figure 12:
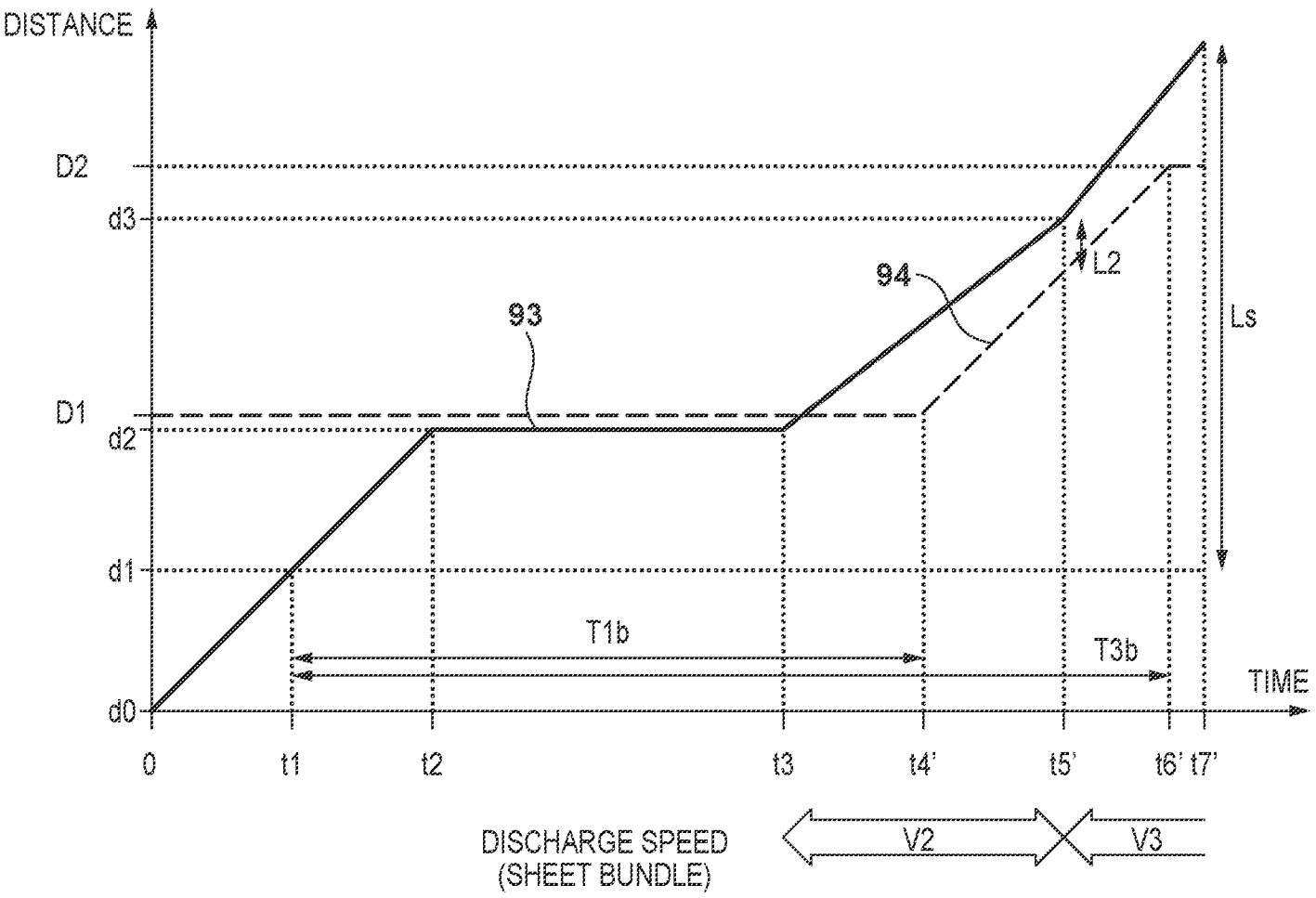
FIG. 12 is a timing chart illustrating transport speed control in the first variation.

FIG. 12 is a timing chart illustrating the positional relationship between the protrusible tray 61 and the sheet bundle when the sheet bundle is constituted by sheets which are to be discharged at a low speed (sheets which produce louder collision sounds) in the present variation. A solid line graph 93 represents the position of the leading edge of the sheet bundle, which changes with time. A broken line graph 94 represents the position of the leading edge of the protrusible tray 61, which changes with time.

The leading edge of the sheet bundle, which is pushed by the discharge guide 34 and has started moving, reaches the detection position d1 of the exit sensor 60 at time t1. The discharge control unit 430, for example, starts a timer at this point in time, and starts monitoring the passage of time. At time t2, the leading edge of the sheet bundle reaches the position d2 of the discharge rollers 36. From time t2 to time t3, the position of the leading edge of the sheet bundle is kept at the position d2, and the gap between the upper roller 36*a* and the lower roller 36*b* of the discharge rollers 36 is reduced to pinch the sheet bundle. At time t3, the discharge rollers 36 start rotating, and the leading edge of the sheet bundle moves in the discharge direction X2 at the discharge speed V2 (i.e., a speed slower than the example illustrated in FIG. 9). At time t4', the tray control unit 432 causes the protrusible tray 61 to start protruding. The tray control unit 432 can determine the timing at which the protrusible tray 61 is to start protruding based on, for example, the timer measuring a time duration T1*b*(=t4'−t1). At time t5', the leading edge of the sheet bundle reaches the position d3 of abutment with the pressing member 62. At this time, the leading edge of the protrusible tray 61 is positioned behind the leading edge of the sheet bundle by a distance L2. At time t5', the sheet control unit 431 increases the rotation speed of the discharge rollers 36, and the leading edge of the sheet bundle moves in the discharge direction X2 at the discharge speed V3. At time t6', the leading edge of the protrusible tray 61 reaches the maximum protruding position D2, whereupon the protrusible tray 61 stops. The tray control unit 432 can determine the timing at which the protrusible tray 61 is to stop based on, for example, the timer measuring a time duration T3*b*(=t6'−t1). At time t7', the following edge of the sheet bundle reaches the position d1. When the following edge of the sheet bundle is detected by the exit sensor 60, the tray control unit 432 causes the protrusible tray 61 to start retracting.

In the present variation, the movement speed of the discharge guide 34, the speed at which the roller pair in the discharge rollers 36 closes (the standby time from time t2 to time t3), the protrusion speed of the protrusible tray 61, and the positions d1, d2, d3, D1, and D2 are assumed to be the same as in the above-described example. In this case, assuming the time duration T1*b* is equal to the time duration T1, the distance L2 between the leading edge of the sheet bundle at time t5', at which the leading edge of the sheet bundle reaches the position d3, and the leading edge of the protrusible tray 61, is shorter than the distance L1 in the above-described example. For example, when the distance between the position d2 and the position d3 is 20 mm, and the discharge speed V2 is 150 mm/s, the time required from time t3 to time t5' is 133 ms, which, compared to the above-described example, is 33 ms longer. During this time, the protrusible tray 61 protrudes an extra 67 mm (=200 mm/s×0.33 s), and thus L2=3.3 mm. When the sheet size is A4 (297 mm long on the longer side in the discharge direction) and a position 20 mm from the leading edge of the sheet is pinched by the roller pair in the discharge rollers 36, the distance by which the sheet bundle is discharged by the discharge rollers 36 is 277 mm (297 mm−20 mm). In this case, the time required from time t3 to time t7 in the above-described example is 1385 ms, obtained by dividing the discharge distance of 277 mm by the discharge speed of 200 mm/s. Accordingly, in the present variation, when the discharge speed V3 after reaching the pressing member 62 is set to 205.3 mm/s (=(277 mm−20 mm)/(1385 ms−133 ms)), a timing t7' at which the discharge is complete is equal to the timing t7 in the above-described example. In this case, the productivity of the post-processing apparatus 4 can be kept constant regardless of the type of sheets.

In the present variation, the discharge speed of the sheet bundle when the leading edge of the sheet bundle reaches the position d3 of the pressing member 62 is set variably according to the type of the sheets, and thus when a sheet which is likely to produce a greater collision sound is discharged, the collision sound that is actually produced can be reduced. Additionally, a drop in productivity stemming from the reduction of collision sounds can be compensated for by setting the discharge speed to be relatively lower up to when the leading edge of the sheet bundle reaches the position d3 of the pressing member 62 and then increasing the discharge speed after the leading edge reaches the position d3.

Note that the sheet control unit 431 may change the discharge speed of the sheet bundle at a timing different from the timing at which the leading edge of the sheet bundle reaches the position d3 of the pressing member 62. Additionally, the sheet control unit 431 may change the discharge speed of the sheet bundle several times instead of once. For example, the sheet control unit 431 may lower the discharge speed in stages before the leading edge of the sheet bundle reaches the position d3 of the pressing member 62. Additionally, after the leading edge of the sheet bundle reaches the position d3 of the pressing member 62, the sheet control unit 431 may eliminate delay by temporarily increasing the discharge speed to a speed higher than the aforementioned V1, and then reduce the discharge speed to the speed V1.

10-2. Second Variation

In a second variation, the finisher control unit 400 of the post-processing apparatus 4 sets the timing at which the protrusible tray 61 protrudes from the retracted position in a variable manner. More specifically, the finisher control unit 400 sets the standby time duration until the protrusible tray 61 protrudes to one of at least two candidate values based on the type of the sheets contained in the sheet bundle. Assume, for example, that one type of sheet is plain paper, and another type of sheet is light paper, which is thinner than plain paper. A sheet bundle constituted by light paper has a property of bending more easily than a sheet bundle constituted by plain paper, and the attitude thereof is more likely to become disarrayed due to the leading edge part of the sheet bundle drooping downward from the leading edge of the protrusible tray 61. Accordingly, when a sheet bundle constituted by light paper is discharged, the finisher control unit 400 sets the standby time duration until the protrusible tray 61 protrudes to a value shorter than the normal standby time duration. This shortens the distance between the leading edge of the sheet bundle and the leading edge of the protrusible tray 61, which in turn prevents the attitude from becoming disarrayed due to the leading edge part of the sheet bundle drooping downward. In this case too, the movement of the protrusible tray 61 is controlled such that the protrusible tray 61 reaches the position of the pressing member 62 after the sheet bundle abuts with the pressing member 62.

Figure 13:
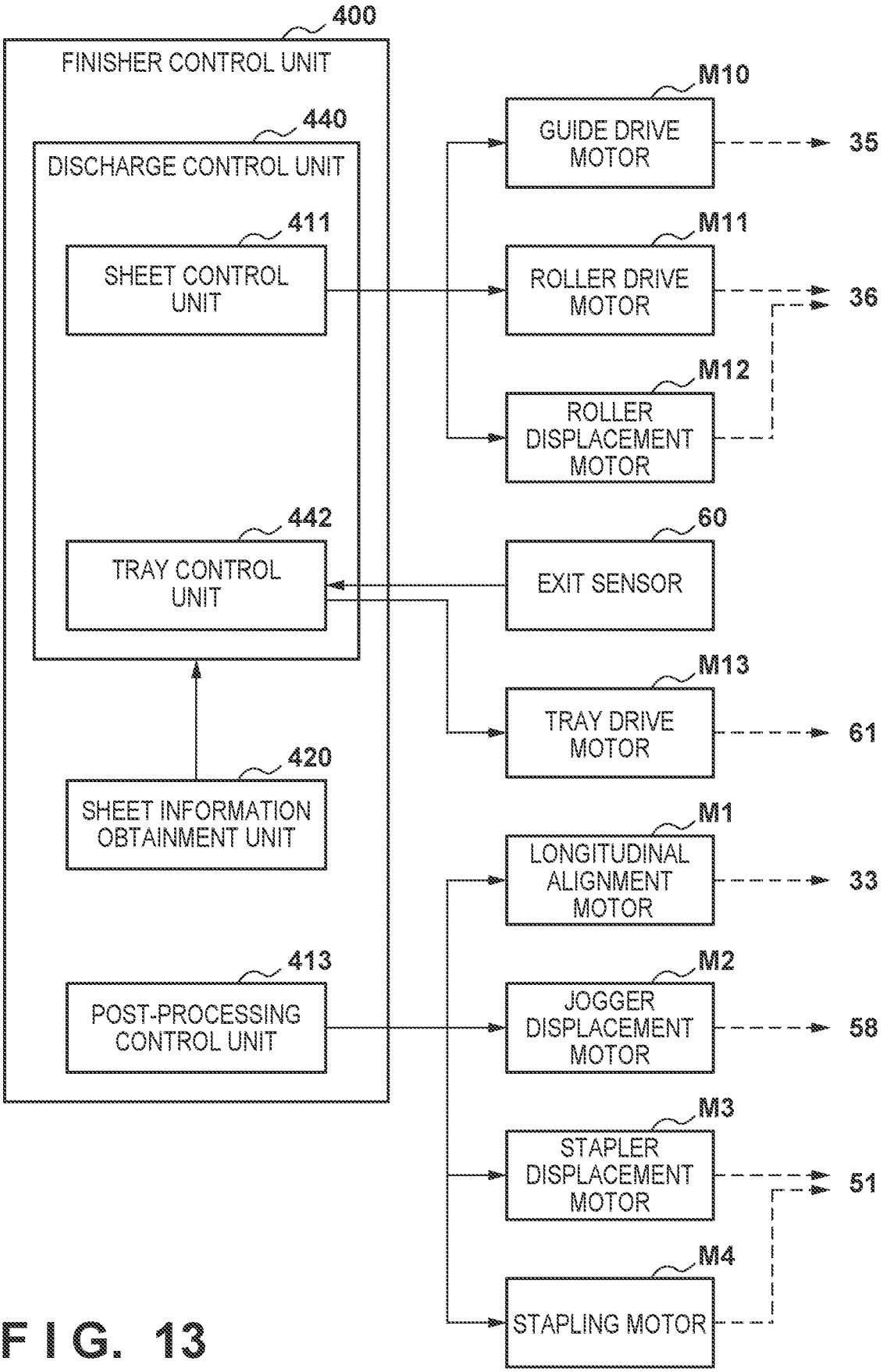
FIG. 13 is a block diagram illustrating, in detail, an example of configurations related to a discharge control function of the post-processing apparatus according to a second variation.

In the present variation, the configurations of the image forming system 1*s*, the image forming apparatus 1, the reading apparatus 2, and the post-processing apparatus 4 may be the same as the configurations described above, with the exception of parts related to the discharge control function of the post-processing apparatus 4, illustrated in FIG. 13.

FIG. 13 is a block diagram illustrating, in further detail, an example of configurations related to the discharge control function of the post-processing apparatus 4 according to the present variation. Referring to FIG. 13, the finisher control unit 400 of the post-processing apparatus 4 includes the post-processing control unit 413, a sheet information obtainment unit 420, and a discharge control unit 440. The discharge control unit 440 includes the sheet control unit 411 and a tray control unit 442.

In the present variation, similar to the tray control unit 412 described above, the tray control unit 442 monitors the sensor signal from the exit sensor 60. The tray control unit 442 stands by for a given time duration after the exit sensor 60 detects the leading edge of the sheet bundle transported by the discharge guide 34, and then causes the protrusible tray 61 to start protruding from the retracted position. The tray control unit 442 sets the standby time duration, before the protrusible tray 61 starts protruding, based on the type information input from the sheet information obtainment unit 420. For example, when the type information indicates that the type of the sheets constituting the sheet bundle is "plain paper", the tray control unit 442 sets the standby time duration to a first value T1. On the other hand, when the type information indicates that the type of the sheets constituting the sheet bundle is "light paper", the tray control unit 442 sets the standby time duration to a second value T1*c* that is less than the first value T1. The protrusion speed of the protrusible tray 61 in the present variation may be constant regardless of the type of the sheet, or may change partway through the protrusion. When the following edge of the sheet bundle is detected by the exit sensor 60, the tray control unit 442 causes the protrusible tray 61 to retract to the original retracted position.

Figure 14:
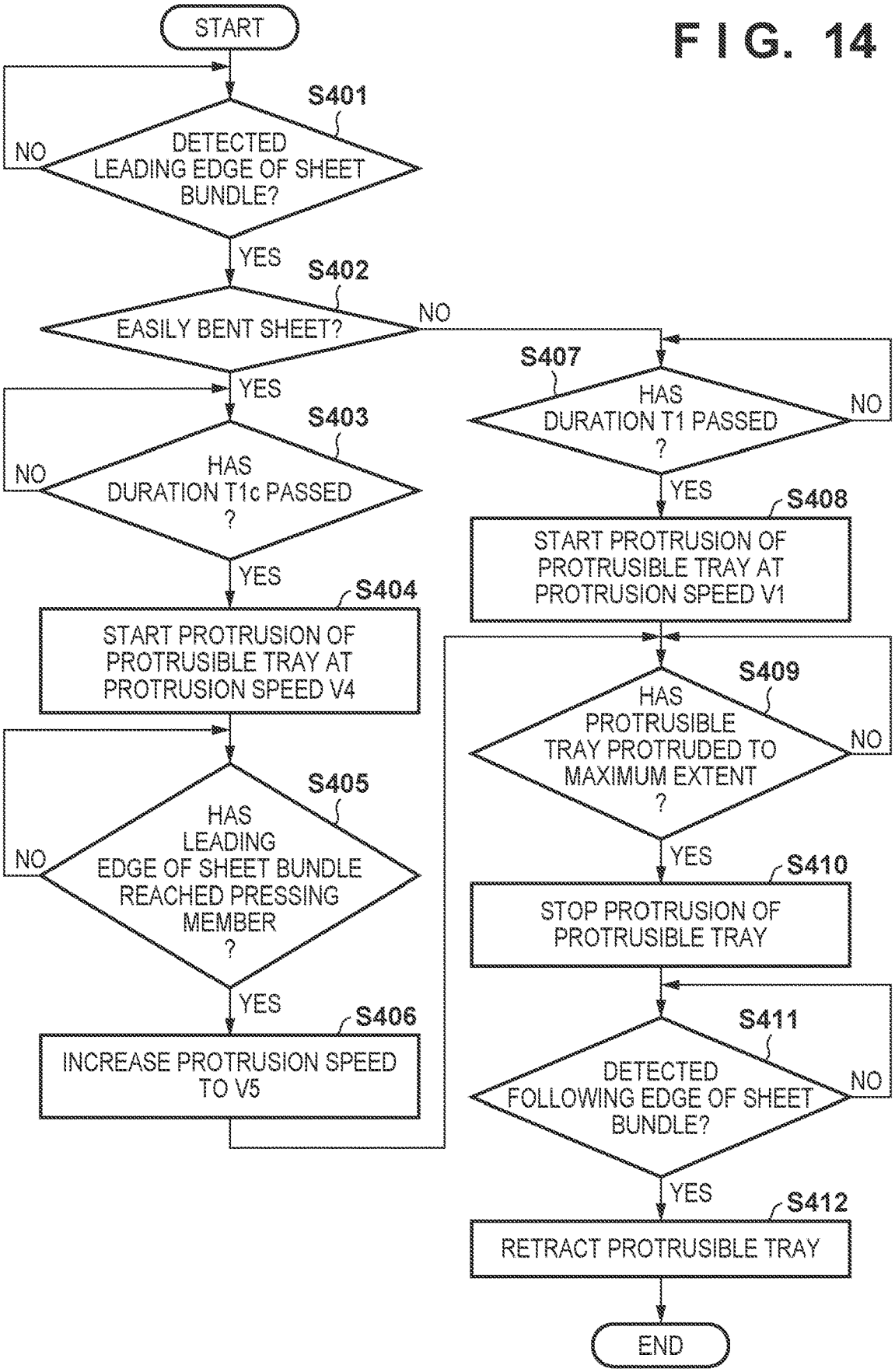
FIG. 14 is a flowchart illustrating an example of the flow of protrusion control processing according to the second variation.

FIG. 14 is a flowchart illustrating an example of the flow of protrusion control processing performed by the tray control unit 442 according to the present variation. Referring to FIG. 14, first, in step S401, the tray control unit 442 stands by until the exit sensor 60 detects the leading edge of the sheet bundle. The sequence moves to step S402 when the leading edge of the sheet bundle is detected. The processing that follows thereafter branches depending on the type of the sheet indicated by the type information obtained by the sheet information obtainment unit 420. The sequence moves to step S403 when the type information indicates a sheet that bends easily (e.g., "light paper"). On the other hand, the sequence moves to step S407 when the type information does not indicate a sheet that bends easily.

In step S403, the tray control unit 442 stands by until a time duration T1*c* set for sheets that bend easily passes. The sequence moves to step S404 once the time duration T1*c* has passed. In step S404, the tray control unit 442 causes the protrusible tray 61 to start protruding from the retracted position at a fourth speed V4 that is slower than the first speed V1. Next, in step S405, the tray control unit 442 stands by until the leading edge of the sheet bundle reaches the position of the pressing member 62. The sequence moves to step S406 when the leading edge of the sheet bundle reaches the position of the pressing member 62. In step S406, the tray control unit 442 increases the protrusion speed of the protrusible tray 61 from the fourth speed V4 to a fifth speed V5.

On the other hand, in step S407, the tray control unit 442 stands by until the time duration T1 set for normal sheets passes. The sequence moves to step S408 once the time duration T1 has passed. In step S408, the tray control unit 442 causes the protrusible tray 61 to start protruding from the retracted position at the first speed V1.

Then, in step S409, while causing the protrusible tray 61 to protrude, the tray control unit 442 stands by until the protrusible tray 61 protrudes to the maximum extent. The sequence moves to step S410 once the protrusible tray 61 has protruded to the maximum extent. In step S410, the tray control unit 442 causes the protrusible tray 61 to stop protruding. Next, in step S411, the tray control unit 442 stands by until the exit sensor 60 detects the following edge of the sheet bundle. The sequence moves to step S412 when the following edge of the sheet bundle is detected. In step S412, the tray control unit 442 causes the protrusible tray 61 to retract from the protruding position to the original retracted position.

Figure 15:
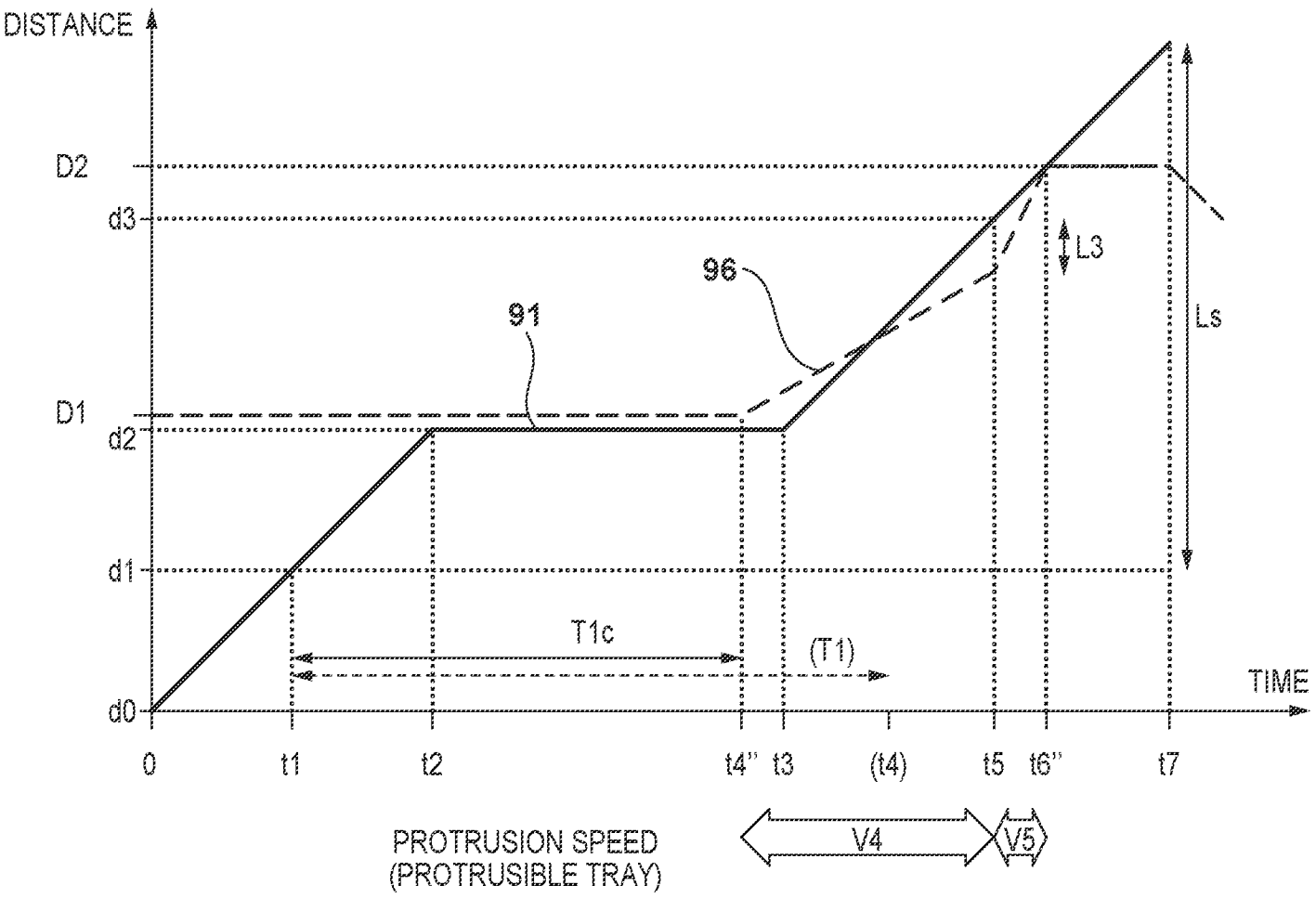
FIG. 15 is a timing chart illustrating protrusion timing control in the second variation.

FIG. 15 is a timing chart illustrating the positional relationship between the protrusible tray 61 and the sheet bundle when the sheet bundle is constituted by sheets which bend easily in the present variation. The solid line graph 91 is the same as that in FIG. 9. A broken line graph 96 represents the position of the leading edge of the protrusible tray 61, which changes with time, in the present variation.

The leading edge of the sheet bundle, which is pushed by the discharge guide 34 and has started moving, reaches the detection position d1 of the exit sensor 60 at time t1. The discharge control unit 440, for example, starts a timer at this point in time, and starts monitoring the passage of time. At time t2, the leading edge of the sheet bundle reaches the position d2 of the discharge rollers 36. From time t2 to time t3, the position of the leading edge of the sheet bundle is kept at the position d2, and the gap between the upper roller 36*a* and the lower roller 36*b* of the discharge rollers 36 is reduced to pinch the sheet bundle. At time t4", the tray control unit 442 causes the protrusible tray 61 to start protruding at the protrusion speed V4. The tray control unit 442 can determine the timing at which the protrusible tray 61 is to start protruding based on, for example, the timer measuring the time duration T1*c* (T1*c*<T1). At time t3, the discharge rollers 36 start rotating, and the leading edge of the sheet bundle moves in the discharge direction X2 at the discharge speed V1. The leading edge of the sheet bundle overtakes the leading edge of the protrusible tray 61 at a given point in time between time t3 and time t5. At time t5, the leading edge of the sheet bundle reaches the position d3 of abutment with the pressing member 62. At this time, the leading edge of the protrusible tray 61 is positioned behind the leading edge of the sheet bundle by a distance L3. The distance L3 is shorter than the aforementioned distance L1. At time t5, the tray control unit 442 increases the protrusion speed of the protrusible tray 61 to the speed V5. At time t6", the leading edge of the protrusible tray 61 reaches the maximum protruding position D2, whereupon the protrusible tray 61 stops. At time t7, the following edge of the sheet bundle reaches the position d1. When the following edge of the sheet bundle is detected by the exit sensor 60, the tray control unit 442 causes the protrusible tray 61 to start retracting.

In the present variation, the movement speed of the discharge guide 34, the speed at which the roller pair in the discharge rollers 36 closes (the standby time from time t2 to time t3), the discharge speed of the sheet bundle, and the positions d1, d2, d3, D1, and D2 are assumed to be the same as in the above-described example. The position d2 of the discharge rollers 36 is also assumed to coincide with the position d1 of the tip of the protrusible tray 61 which is in the retracted position. In this case, assuming, for example, that the time duration T1*c* is 380 ms, the protrusible tray 61 starts protruding 20 ms before time t3. Additionally, the discharge speed V1 of the sheet bundle is 200 mm/s, and the distance between the position d2 and the position d3 is 20 mm. As such, assuming the protrusion speed V4 of the protrusible tray 61 is 150 mm/s, at time t5, the leading edge of the protrusible tray 61 is located the distance L3, that is, 2 mm, from the leading edge of the sheet bundle which has reached the position d3 of the pressing member 62. This is one-fifth the distance L1, which is 10 mm, in the above-described example. Furthermore, when the distance between the position d3 of the pressing member 62 and the maximum protruding position D2 of the protrusible tray 61 is 40 mm, increasing the protrusion speed of the protrusible tray 61 to the speed V5, that is, 210 mm/s, at time t5 results in the leading edge of the protrusible tray 61 catching up with the leading edge of the sheet bundle at the position d2 at time t6".

In the present variation, the distance between the leading edge of the sheet bundle and the leading edge of the protrusible tray 61 while the sheet bundle is being discharged is shortened according to the type of the sheet, which makes it possible to suppress disturbance in the alignment caused by sheets, which bend easily, drooping downward during discharge.

Note that the tray control unit 442 may change the protrusion speed of the protrusible tray 61 at a timing different from the timing at which the leading edge of the sheet bundle reaches the position d3 of the pressing member 62. Additionally, the tray control unit 442 may change the protrusion speed of the protrusible tray 61 several times instead of once. Additionally, the leading edge of the protrusible tray 61 may overtake the leading edge of the sheet bundle after the leading edge of the sheet bundle reaches the position d3 of the pressing member 62. Furthermore, the tray control unit 442 may set the standby time duration T1*c* to a value equal to T1, cause the protrusible tray 61 to protrude at a protrusion speed higher than the discharge speed of the sheet bundle, and then reduce the speed of the protrusible tray 61 after the leading edge of the protrusible tray 61 is close enough to the leading edge of the sheet bundle.

11. Conclusion

Thus far, various embodiments, examples, and variations of the technique according to the present disclosure have been described with reference to FIGS. 1 to 15. According to the embodiments described above, the control unit of the sheet processing apparatus controls movement of the protrusible tray such that the protrusible tray reaches the position of the pressing member after the sheet bundle discharged from the discharge port abuts with the pressing member. Accordingly, the alignment of the sheets can be improved by using both the pressing member and the protrusible tray, and collision sounds caused by collisions between the pressing member and the protrusible tray can be reduced.

Additionally, in the embodiment described above, the control unit controls the timing at which the protrusible tray is caused to protrude from the retracted position based on the timing at which a sensor detects that the sheet bundle has reached a detection position in the transport path. Controlling the timing of the protrusion of the protrusible tray based on the timing of the transport of the sheet bundle in this manner makes it possible to cause the protrusible tray to protrude while maintaining an appropriate positional relationship between the sheet bundle and the protrusible tray with ease.

In one example, the control unit may cause the protrusible tray to start protruding at a second point in time (t4) which is a first time duration (T1) after a first point in time (t1) at which the sheet bundle is detected to have reached the detection position of the sensor. In this case, the sheet bundle can be discharged a desired distance during the first time duration, and a sufficient distance can be provided between the leading edge of the sheet bundle and the leading edge of the protrusible tray. In this example, the discharge of the sheet bundle from the discharge port may be started at a third point in time (t3) before the second point in time (t4), and the protrusion speed of the protrusible tray may be set to be equal to the discharge speed of the sheet bundle. This makes it possible to discharge the sheet bundle in a stable manner while keeping the distance between the leading edge of the sheet bundle and the leading edge of the protrusible tray constant, and effectively keep the sheet bundle aligned.

In the first variation, the control unit sets the discharge speed of the sheet bundle in a variable manner based on the type of the sheets constituting the sheet bundle. This makes it possible to flexibly reduce collision sounds caused by collisions between the sheet bundle and the pressing member. For example, when a type of sheet which is likely to produce loud collision sounds is processed, setting the discharge speed of the sheet bundle to a second speed (V2) slower than a first speed (V1) makes it possible to prevent loud collision sounds, which are unpleasant for users, from being produced. Additionally, a drop in productivity caused by temporarily reducing the discharge speed can be compensated for by changing the discharge speed from the second speed (V2) to a faster third speed (V3) after the sheet bundle abuts with the pressing member.

In the second variation, the control unit sets the first time duration in a variable manner based on the type of the sheets constituting the sheet bundle. This makes it possible to flexibly adjust the distance between the leading edge of the sheet bundle and the leading edge of the protrusible tray, and effectively suppress disturbance in the alignment of the sheet bundle. For example, when processing a type of sheet which bends easily, setting the first time duration for which to stand by before the protrusible tray starts to protrude to a second value (T1*b*) shorter than a first value (T1) makes it possible to prevent the leading edge of the sheet bundle preceding the protrusible tray from drooping downward excessively. In addition, or instead, when a type of sheet that bends easily is processed, the protrusion speed of the protrusible tray may be set in a variable manner such that the distance between the leading edge of the sheet bundle and the leading edge of the protrusible tray during discharge is shorter than when not processing that type of sheet. Such a method also prevents the leading edge of the sheet bundle preceding the protrusible tray from drooping down excessively.

Additionally, in the embodiment described above, the pressing member is configured to be capable of pivoting about a pivot shaft, and the pressing member is pressed by the sheet bundle and pivots after the sheet bundle abuts with the pressing member. In this case, the top surface of the sheet bundle can be pressed down, facilitating discharge to a discharge tray, using a simple configuration, even without dynamically controlling the movement of the pressing member when the sheet bundle is discharged.

12. Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2022-063058, filed on Apr. 5, 2022 which is hereby incorporated by reference herein in its entirety.

What is claimed is:

1. A sheet processing apparatus comprising:

a discharge unit configured to discharge, from a discharge port, a sheet bundle transported along a transport path;

a loading unit onto which the sheet bundle that has been discharged is loaded;

an abutting unit disposed forward from the discharge port in a discharge direction of the sheet bundle so that the abutting unit abuts with a top surface of the sheet bundle that has been discharged;

a support unit that is protrusible from and retractable into the discharge port and is configured to protrude to an underside of the sheet bundle temporarily to support the sheet bundle when the sheet bundle is discharged; and a control unit configured to control movement of the support unit such that the support unit reaches a position of the abutting unit after the sheet bundle abuts with the abutting unit.

2. The sheet processing apparatus according to claim 1, further comprising a detection unit configured to detect the sheet bundle reaching a detection position in the transport path, wherein based on a timing at which the detection unit detects that the sheet bundle has reached the detection position, the control unit is configured to control a timing at which to cause the support unit to protrude from a retracted position.

3. The sheet processing apparatus according to claim 2, wherein the control unit is configured to cause the support unit to start protruding at a second point in time which is a first time duration after a first point in time, where the first point in time is a point in time when the detection unit detects that the sheet bundle has reached the detection position.

4. The sheet processing apparatus according to claim 3, wherein the control unit is configured to cause the discharge unit to start discharging the sheet bundle at a third point in time that is earlier than the second point in time, and a discharge speed at which the discharge unit discharges the sheet bundle is equal to a protrusion speed at which the support unit protrudes.

5. The sheet processing apparatus according to claim 3, wherein the control unit is configured to set the first time duration in a variable manner based on a type of sheets constituting the sheet bundle.

6. The sheet processing apparatus according to claim 5, wherein the control unit is configured to:

set the first time duration to a first value when the type of sheets constituting the sheet bundle is a first type; and set the first time duration to a second value lower than the first value when the type of sheets constituting the sheet bundle is a second type that bends more easily than the first type.

7. The sheet processing apparatus according to claim 3, wherein the control unit is configured to set one or both of the first time duration and a protrusion speed of the support unit such that a distance between a leading edge of the support unit and a leading edge of the sheet bundle during discharge of the sheet bundle in a case where the type of sheets constituting the sheet bundle is a second type that bends more easily than a first type is shorter than a distance between the leading edge of the support unit and the leading edge of the sheet bundle during discharge of the sheet bundle in a case where the type of sheets constituting the sheet bundle is the first type.

8. The sheet processing apparatus according to claim 1, wherein the control unit is configured to set a discharge speed at which the discharge unit discharges the sheet bundle in a variable manner based on a type of sheets constituting the sheet bundle.

9. The sheet processing apparatus according to claim 8, wherein the control unit is configured to:

set the discharge speed to a first speed when the type of sheets constituting the sheet bundle is a first type, and set the discharge speed to a second speed slower than the first speed when the type of sheets constituting the sheet bundle is a third type configured to be more likely to produce a collision sound than the first type.

10. The sheet processing apparatus according to claim 9, wherein, when the type of sheets constituting the sheet bundle is the third type, the control unit is configured to change the discharge speed from the second speed to a third speed faster than the second speed after the sheet bundle abuts with the abutting unit.

11. The sheet processing apparatus according to claim 1, wherein the abutting unit is capable of pivoting about a pivot shaft, and the abutting unit is pressed by the sheet bundle and pivots after the sheet bundle abuts with the abutting unit.

12. The sheet processing apparatus according to claim 1, further comprising:

a processing unit is configured to perform at least one of alignment processing of aligning the sheet bundle and stapling processing of stapling the sheet bundle; and a transport unit is configured to transport the sheet bundle processed by the processing unit along the transport path and passes the sheet bundle to the discharge unit.

13. An image forming system comprising:

an image forming apparatus configured to form an image on a sheet; and the sheet processing apparatus according to claim 1, wherein the sheet processing apparatus is connected to the image forming apparatus and is configured to receive a sheet from the image forming apparatus to process the sheet.

* * * * *